US011866653B1

(12) United States Patent
Choi et al.

(10) Patent No.: US 11,866,653 B1
(45) Date of Patent: Jan. 9, 2024

(54) PROCESSES AND SYSTEMS FOR UPGRADING CRUDE OIL

(71) Applicant: Saudi Arabian Oil Company, Dhahran (SA)

(72) Inventors: Ki-Hyouk Choi, Dhahran (SA); Faisal Mohammed Almulla, Dhahran (SA); Seung-Hak Choi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/052,304

(22) Filed: Nov. 3, 2022

(51) Int. Cl.
*C10G 53/02* (2006.01)

(52) U.S. Cl.
CPC ..... *C10G 53/02* (2013.01); *C10G 2300/1033* (2013.01); *C10G 2300/4006* (2013.01); *C10G 2300/4012* (2013.01)

(58) Field of Classification Search
CPC ..... C10G 53/02; C10G 2300/1033; C10G 2300/4006; C10G 2300/4012
See application file for complete search history.

(56) References Cited

U.S. PATENT DOCUMENTS 6,264,844 B1 7/2001 Modell et al.
8,535,518 B2 9/2013 Choi et al.
9,005,423 B2 4/2015 Choi et al.
9,382,485 B2 7/2016 Choi et al.
9,914,885 B2 3/2018 Choi et al.
9,951,283 B2 4/2018 Choi et al.
10,066,172 B2 9/2018 Choi et al.
2006/0011511 A1* 1/2006 Hokari ..... B01J 3/008 422/600
2011/0315600 A1* 12/2011 Choi ..... C10G 21/08 208/97
2012/0061294 A1 3/2012 Choi et al.
(Continued)

OTHER PUBLICATIONS

Ates et al., "The role of catalyst in supercritical water desulfurization", Applied Catalysis B, Environmental, http://dx.doi.org/10.1016/j.apcatb.2013.08.018, 2010.
(Continued)

*Primary Examiner* — Ellen M McAvoy
*Assistant Examiner* — Chantel Graham
(74) *Attorney, Agent, or Firm* — DINSMORE & SHOHL LLP

(57) ABSTRACT

A process for upgrading crude oil may include combining crude oil and feed water in a supercritical water unit to produce a first upgraded output, separating the first upgraded output in a first gas-water-oil separator to produce a first gas effluent, a first water effluent, and a first oil effluent, separating the first water effluent in a first water treatment unit to produce a rejected water stream and a recycle water stream, combining the first oil effluent and the rejected water stream in a nearcritical water unit to produce a second upgraded output, and recycling at least a portion of the recycle water stream for introduction into the supercritical water unit. A system for upgrading crude oil may include a supercritical water unit, a first gas-water-oil separator disposed downstream of the supercritical water unit, a first water treatment unit disposed downstream of the first gas-water-oil separator, and a nearcritical water unit.

20 Claims, 5 Drawing Sheets

(56) References Cited

U.S. PATENT DOCUMENTS

| | | | |
|---|---|---|---|
| 2012/0181217 | A1 | 7/2012 | Choi et al. |
| 2016/0312129 | A1 | 10/2016 | Choi et al. |

OTHER PUBLICATIONS

Kishita et al., "Hydrothermal Visbreaking of Bitumen in Supercritical Water with Alkali", Journal of the Japan Petroleum Institute, vol. 45, No. 6, pp. 361-367, 2002.
Kishita et al., "Upgrading of Bitumen by Hydrothermal Visbreaking in Supercritical Water with Alkali", Journal of the Japan Petroleum Institute, vol. 46, No. 4, pp. 215-221, 2003.
Kishita et al., "Desulfurization of Bitumen by Hyudrothermal Upgrading Process in Supercritical Water with Alkali", Japan Petroleum Institute, vol. 49, No. 4, pp. 177-185, 2006.
Kruse et al., "Hot compressed water as reaction medium and reactant Properties and synthesis reactions", J. of Supercritical Fluids, vol. 39, pp. 362-380, 2007.
Prado et al., "Sub- and supercritical water hydrolysis of agricultural and food industry residues for the production of fermentable sugars: A review", Food and Bioproducts Processing, vol. 98, pp. 95-123, 2016.
Vogelaar et al., "Applicability of supercritical water as a reaction medium for desulfurisation and demetallisation of gasoil", Fuel Processing Technology, vol. 61, pp. 265-277, 1999.
Voisin et al., "Solubility of inorganic salts in sub- and supercritical hydrothermal environment: Application to SCWO processes", J. of Supercritical Fluids, vol. 120, pp. 18-31, 2017.
Yuan et al., "Solvation of hydrocarbon radicals in sub-CW and SCW: an ab initio MD study", J. of Supercritical Fluids, vol. 58, pp. 93-98, 2011.

* cited by examiner

PROCESSES AND SYSTEMS FOR UPGRADING CRUDE OIL

TECHNICAL FIELD

Embodiments described herein generally relate to petroleum products, and pertain particularly to processes and systems for upgrading crude oil using a combination of supercritical water and nearcritical water.

BACKGROUND

Conventional crude oil refining plants process crude oils to produce liquid fuels, chemical feedstocks, chemicals, and other petroleum-derived products. However, conventional oil refining schemes can be extremely complex and expensive to operate. Furthermore, many conventional oil refining schemes are inefficient, because they struggle to convert heavy fractions into valuable petroleum-derived products, and they produce large amounts of waste that can be costly to dispose. As oil costs rise, both oil refineries and consumers need oil refining schemes that can help to lower refinery costs by increasing the production of high-value petroleum-derived products, minimizing waste production, and decreasing damage to the refining equipment that could necessitate costly repairs or result in lost production time.

The hydrocarbons contained in crude oil have a wide range of boiling points. For example, gaseous compounds such as propane, butane, and pentane have relatively low boiling points, whereas polyaromatic hydrocarbons in multiple stacking structures have relatively high boiling points. Heteroatoms such as sulfur, nitrogen, oxygen and metals can also impact the boiling points of hydrocarbons in crude oil. Given the wide range of boiling points possessed by the compounds in crude oil, most refining plants process crude oil through conversion processes or through heteroatom removal processes.

In a conversion process, large hydrocarbon molecules with high boiling points (for example, boiling points above 600° F.) are cracked into lighter hydrocarbon molecules with lower boiling points (for example, boiling points below 600° F.). Conventional conversion processes are characterized by two routes: hydrogen addition and carbon rejection. In a hydrogen addition route, externally supplied hydrogen is reacted with hydrocarbons with the aid of a catalyst to induce numerous chemical reactions, including cracking, isomerization, dealkylation, hydrogenation, and reforming. Generally, in the hydrogen addition route, heteroatoms are removed by hydrodesulfurization, hydronitrogenation, hydrodeoxygenation, or hydrodemetallization. However, in the carbon rejection route, some of the hydrogen atoms in hydrocarbons are redistributed by hydrogen transfer reactions, and the hydrocarbons are cracked by radical reaction network reactions. The carbon rejection route creates a hydrogen depleted fraction that becomes solid coke. Although the carbon rejection route removes some heteroatoms from the crude oil products, the hydrogen addition route has a stronger capability for heteroatom removal. The carbon rejection route has many advantages over the hydrogen addition route, including wide flexibility in acceptable feed, comparatively simple process scheme, and lower operating cost. However, the carbon rejection route also has several disadvantages, including producing large amounts of low economic value coke, producing poor quality liquid products, and limited conversion of heavy fractions.

SUMMARY

Utilizing supercritical water to assist in the carbon rejection route can capture the advantages coupled with foregoing an external hydrogen supply, including decreased complexity and lower operating cost, while minimizing the disadvantages of the carbon rejection route. Using supercritical water allows for uniform heat transfer to the hydrocarbons in the crude oil. Supercritical water also decreases coke formation and improves liquid product yield by diluting the hydrocarbons in the crude oil and forming cages of supercritical water molecules around the hydrocarbons to suppress inter-radical reactions. However, the dilution and cage formation also retards other radical reactions, which may slow the cracking of hydrocarbons and lead to the limited conversion of heavy hydrocarbons. Additionally, supercritical water conditions, in the absence of external supply of hydrogen, may limit the removal of heteroatoms. For example, most aromatic sulfur compounds in crude oil have benzothiophenic structure where the carbon-sulfur bond dissociation energy is much higher than other types of aliphatic sulfur compounds such as thiols. Such stable bonds limit heteroatom removal under supercritical water conditions.

Adding catalysts to supercritical water can improve the removal of heteroatoms such as those found in aromatic sulfur compounds, and the high temperature of supercritical water is sufficient to gain meaningful catalytic activity from low concentrations of catalysts. However, the harsh conditions of supercritical water make heterogeneous catalysts less stable, which makes the heterogeneous catalysts less desirable for industrial application. Homogenous catalysts, most of which are metal organics or metal salts, also lose their homogeneity by transforming into insoluble solids when exposed to supercritical water. These insoluble solids can cause buildup on reactor walls, can cause corrosion, and can plug process lines. To avoid these insoluble solids, a very low concentration of salt must be maintained under industrial conditions, as an increase in salt concentration can cause insoluble solid precipitation that could damage the reactor or slow upgraded crude oil production. Thus, processes and systems for upgrading crude oil that capture the advantages of using supercritical water while capturing meaningful catalytic activity and minimizing catalyst precipitation are needed.

Embodiments of the present disclosure meet this need by providing a process and a system for upgrading crude oil that captures meaningful catalytic activity by using nearcritical water conditions while minimizing catalyst precipitation under supercritical water conditions.

According to one or more embodiments of the present disclosure, a process for upgrading crude oil is provided. The process may comprise combining crude oil and a feed water in a supercritical water (SCW) unit to produce a first upgraded output. The process may further comprise separating the first upgraded output in a first gas-water-oil separator to produce a first gas effluent, a first water effluent, and a first oil effluent. The process may further comprise separating the first water effluent in a first water treatment unit to produce a rejected water stream and a recycle water stream. The process may further comprise combining the first oil effluent and the rejected water stream in a nearcritical water (NCW) unit to produce a second upgraded output. The process may also further comprise recycling at least a portion of the recycle water stream for introduction into the SCW unit.

According to one or more embodiments, a system for upgrading crude oil is provided. The system may comprise a SCW unit. The system may further comprise a first gas-water-oil separator disposed downstream of the SCW unit. The system may further comprise a first water treatment unit disposed downstream of the first gas-water-oil separator. The system may also further comprise a NCW unit.

It is to be understood that both the preceding general description and the following detailed description describe various embodiments and are intended to provide an overview or framework for understanding the nature and character of the claimed subject matter. Additional features and advantages of the embodiments will be set forth in the detailed description and, in part, will be readily apparent to persons of ordinary skill in the art from that description, which includes the accompanying drawings and claims, or recognized by practicing the described embodiments. The drawings are included to provide a further understanding of the embodiments and, together with the detailed description, serve to explain the principles and operations of the claimed subject matter. However, the embodiments depicted in the drawings are illustrative and exemplary in nature, and not intended to limit the claimed subject matter.

BRIEF DESCRIPTION OF DRAWINGS

The following detailed description may be better understood when read in conjunction with the following drawings, in which.

DETAILED DESCRIPTION

Figure 1:
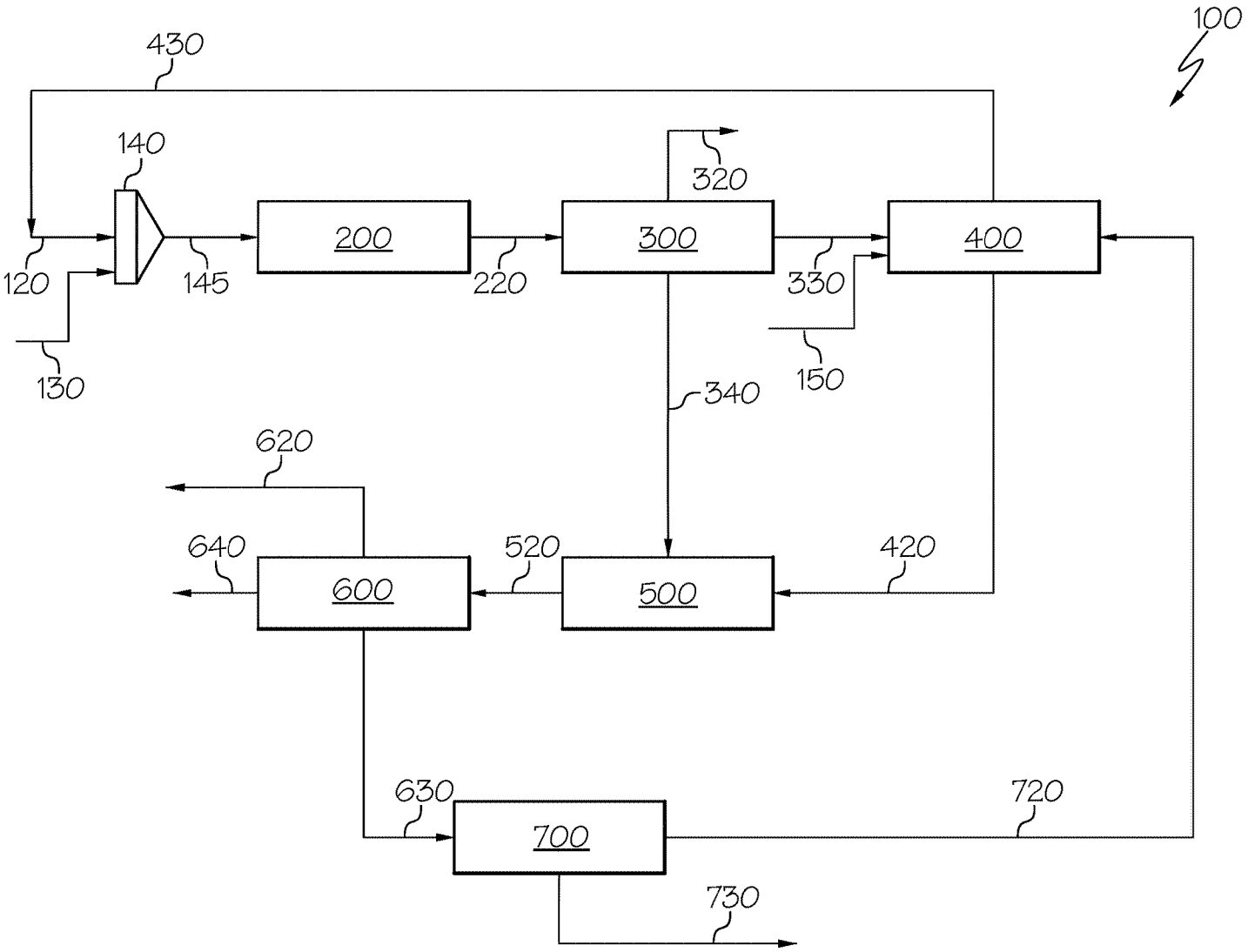
FIG. 1 illustrates a schematic view of an example system for upgrading crude oil that may be suitable for use with the processes for upgrading crude oil.

The present disclosure is generally directed to a process for upgrading crude oil. The process may generally include combining crude oil and feed water in a supercritical water (SCW) unit to produce a first upgraded output. The process may further comprise separating the first upgraded output in a first gas-water-oil separator to produce a first gas effluent, a first water effluent, and a first oil effluent. The process may further comprise separating the first water effluent in a first water treatment unit to produce a rejected water stream and a recycle water stream. The process may further comprise combining the first oil effluent and the rejected water stream in a nearcritical water (NCW) unit to produce a second upgraded output. The process may also comprise recycling at least a portion of the recycle water stream for introduction into the SCW unit.

The present disclosure is also generally directed to a system for upgrading crude oil. The system may generally include a SCW unit. The system may further comprise a first gas-water-oil separator disposed downstream of the SCW unit. The system may further comprise a first water treatment unit disposed downstream of the first gas-water-oil separator. The system may also comprise a NCW unit.

As used in this disclosure, "alkali metal" refers to any metal, metal ion, or salt thereof in Group 1 of the periodic table, including lithium, sodium, potassium, rubidium, cesium, francium, or combinations thereof.

A used in this disclosure, "alkaline earth metal" refers to any metal, metal ion, or salt thereof, in Group II of the periodic table, including beryllium, magnesium, calcium, strontium, barium, radium, or combinations thereof.

As used in this disclosure, a "catalyst" refers to any inorganic substances other than water that increases the rate of a specific chemical reaction.

As used in this disclosure, "cracking" generally refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds. Some catalysts may have multiple forms of catalytic activity, and calling a catalyst by one particular function does not render that catalyst incapable of being catalytically active for other functionality.

As used throughout this disclosure, "crude oil" refers to whole range crude oil, distilled crude oil, residue oil, topped crude oil, product streams from oil refineries, product streams from steam cracking processes, liquefied coals, liquid products recovered from oil or tar sands, bitumen, oil shale, asphaltene, biomass hydrocarbons, liquid product from Gas-to-Liquid (GTL) process, liquid product from chemical recycling of waste plastic/municipal waste, and other similar petroleum-based oils.

As used in this disclosure, "effluent" refers to a stream that is passed out of a reactor, a reaction zone, or a separation unit following a particular reaction or separation. Generally, an effluent has a different composition than the stream that entered the separation unit, reactor, or reaction zone. It should be understood that when an effluent is passed to another system unit, only a portion of that system stream may be passed. For example, a slip stream may carry some of the effluent away, meaning that only a portion of the effluent may enter the downstream system unit.

As used throughout this disclosure, "heavy fraction" refers to the portion of the crude oil that comprises chemical compounds with boiling points equal to or above 650° F., when measured by true boiling point (TBP). As a non-limiting example, a crude oil possesses 10% heavy fraction by weight when, by weight, 10% of the chemical compounds within the crude oil have boiling points equal to or above 650° F., when measured by true boiling point.

As used throughout this disclosure, "homogenous catalyst" refers to a catalyst that is in the same phase as the reactants. For example, a catalyst in a liquid solution would be a homogenous catalyst if the reactants were also in the liquid solution.

As used throughout this disclosure, "standard ambient temperature and pressure" or "SATP" refers to conditions of 25° C. and 100 kPa of pressure.

As used throughout the disclosure, "supercritical" refers to a substance at a pressure and a temperature greater than that of its critical pressure and temperature, such that distinct phases do not exist and the substance may exhibit the diffusion of a gas while dissolving materials like a liquid.

As used throughout this disclosure, "supercritical water" or "SCW" refers to water that is at a temperature above the critical temperature of water and a pressure above the critical pressure of water.

As used throughout this disclosure, "nearcritical water" or "NCW" refers to water that is at a temperature below the critical temperature of water and a pressure above the critical pressure of water.

As used throughout this disclosure, "raw water" refers to underground water, water produced from upstream operations of crude oil production, desalinated water, rejected water from demineralization plants, brackish water, softened water, tap water, river water, reclaimed water, and other similar waters.

As used throughout this disclosure, the terms "upgrade," "upgraded," or "upgrading" refer to the process of at least partially converting at least some less valuable petroleum-based material into at least some greater value chemical products and intermediates. As a non-limiting example, at least some of a crude oil might be upgraded to produce at least some ethylene, propene, and butene.

Now referring to FIG. 1, an example system for upgrading crude oil that may be suitable for use with the processes described herein is schematically depicted. The system 100 generally comprises a supercritical water (SCW) unit 200, a first gas-water-oil separator 300 disposed downstream from the SCW unit 200, a first water treatment unit 400 disposed downstream from the first gas-water-oil separator 300, and a nearcritical water (NCW) unit 500 disposed downstream of the first water treatment unit 400.

In one or more embodiments, the SCW unit 200 upgrades a mixture comprising a crude oil stream 130, and a feed water stream 120. The crude oil stream 130 and feed water stream 120 may be combined in the SCW unit or may be mixed upstream. In one or more embodiments, the crude oil 130 and the feed water 120 may optionally be combined in a mixer 140 to produce a mixture comprising crude oil and water feed. In one or more embodiments, the mixture comprising crude oil and water feed may be heated before being passed to the SCW unit 200. In one or more embodiments, the mixture comprising crude oil and water feed 145 may be adjusted by a heater to below the temperature of the contents of the SCW unit before being passed to the SCW unit 200. In one or more embodiments, the mixer 140 may be an in-line mixer, a tee fitting, a static mixer, a stirred mixer, or other similar mixer. In one or more embodiments, the feed water 120 may have a salinity defined by a conductivity of less than 1 microsiemens (μS)/centimeters (cm). In one or more embodiments, the feed water 120 may have a salinity of less than 1 μS/cm, 0.75 μS/cm, 0.5 μS/cm, 0.25 μS/cm, 0.1 μS/cm, 0.075 μS/cm, 0.065 μS/cm, or 0.060 μS/cm, 0.0575 μS/cm, 0.055 μS/cm, 0.050 μS/cm.

In one or more embodiments, the crude oil may comprise at least 0.2% sulfur by weight. In one or more embodiments, the crude oil may comprise at least 0.2%, 0.3%, 0.4%, 0.5%, 0.6%, 0.7%, 0.8%, 0.9%, 1%, 2%, 3%, 4%, 4.25%, 5%, or 10% sulfur by weight.

In one or more embodiments, the crude oil may comprise at least 100 ppm nitrogen by weight. In one or more embodiments, the crude oil may comprise at least 100 ppm, 200 ppm, 300 ppm, 400 ppm, 500 ppm, 600 ppm, 700 ppm, 800 ppm, 900 ppm, or 1000 ppm nitrogen by weight.

In one or more embodiments, the crude oil may comprise at least 10% heavy fraction by weight. In one or more embodiments, the crude oil may comprise at least 5%, 10%, 15%, 20%, 25%, 30%, 38%, 35%, 40%, 45%, or 50% heavy fraction by weight.

In one or more embodiments, the crude oil may comprise a salt concentration of greater than or equal to 1 pound per 1000 barrels (pkb) and less than or equal to 200 pkb. In one or more embodiments, the crude oil may comprise a salt concentration of 1 pkb, 2 pkb, 5 pkb, 10 pkb, 20 pkb, 25 pkb, 29 pkb, 30 pkb, 50 pkb, 75 pkb, 100 pkb, 125 pbk, 150 pkb, 175 pkb, or 200 pkb.

In one or more embodiments, the crude oil may be pressurized to a pressure over 21 MPa. In one or more embodiments, the crude oil may be pressurized by a pump. In one or more embodiments, the pump may maintain the crude oil at a pressure of 21 to 35 MPa, 22 to 35 MPa, 23 to 35 MPa, 25 to 35 MPa, 30 to 35 MPa, 21 to 30 MPa, 22 to 30 MPa, 23 to 30 MPa, 25 to 30 MPa, 21 to 25 MPa, 22 to 25 MPa, 23 to 25 MPa, or any combination thereof.

In one or more embodiments, the crude oil may be heated to a temperature of greater than or equal to 50° C. and less than or equal to 350° C. In one or more embodiments, the crude oil may be heated by a heater. In one or more embodiments, the heater may be a fired furnace, an electric heater, a heat exchanger, other similar heaters, or combinations thereof. In one or more embodiments, the crude oil may be heated by the heater to a temperature between 50 to 350° C., 75 to 350° C., 100 to 350° C., 150 to 350° C., 200 to 350° C., 250 to 350° C., 300 to 350° C., 50 to 300° C., 75 to 300° C., 100 to 300° C., 150 to 300° C., 200 to 300° C., 250 to 300° C., 50 to 250° C., 75 to 250° C., 100 to 250° C., 150 to 250° C., 200 to 250° C., 50 to 200° C., 75 to 200° C., 100 to 200° C., 150 to 200° C., 50 to 150° C., 75 to 150° C., 100 to 150° C., 50 to 100° C., 75 to 100° C., 50 to 75° C., or combinations thereof.

In one or more embodiments, the feed water stream may have a salinity defined by a conductivity of less than 1 microsiemens (μS)/centimeters (cm). In one or more embodiments, the feed water may comprise a sodium content less than or equal to 5 μg/L. In one or more embodiments, the feed water may comprise a sodium content less than or equal to 5 μg/L, 4 μg/L, 3 μg/L, 2 μg/L, or 1 μg/L. In one or more embodiments, the feed water may comprise a chloride content of less than or equal to 5 μg/L. In one or more embodiments, the feed water may comprise a chloride content of less than or equal to 5 μg/L, 4 μg/L, 3 μg/L, 2 μg/L, or 1 μg/L. In one or more embodiments, the feed water may comprise a silica content of less than or equal to 3 μg/L. In one or more embodiments, the feed water may comprise a silica content of less than or equal to 5 μg/L, 3 μg/L, 2 μg/L, or 1 μg/L, 0.5 μg/L, or 0.25 μg/L.

In one or more embodiments, the feed water may be pressurized to a pressure over 21 MPa. In one or more embodiments, the feed water may be pressurized by a pump. In one or more embodiments, the pump may maintain the feed water at a pressure of 21 to 35 MPa, 22 to 35 MPa, 23 to 35 MPa, 25 to 35 MPa, 30 to 35 MPa, 21 to 30 MPa, 22 to 30 MPa, 23 to 30 MPa, 25 to 30 MPa, 21 to 25 MPa, 22 to 25 MPa, 23 to 25 MPa, or any combination thereof.

In one or more embodiments, the feed water may be heated to a temperature of greater than or equal to 374° C. In one or more embodiments, the heater may be a fired furnace, an electric heater, a heat exchanger, other similar heaters, or combinations thereof. In one or more embodiments, the feed water may be heated by the heater to a temperature between 374 to 600° C., 400 to 600° C., 425 to 600° C., 450 to 600° C., 500 to 600° C., 550 to 600° C., 374 to 550° C., 400 to 550° C., 425 to 550° C., 450 to 550° C., 500 to 550° C., 374 to 500° C., 400 to 500° C., 425 to 500° C., 450 to 500° C., 374 to 450° C., 400 to 450° C., 425 to 450° C., 374 to 425° C., 400 to 425° C., 374 to 400° C., or combinations thereof.

In one or more embodiments, the mixture comprising crude oil and feed water may have a residence time in the SCW unit of greater than or equal to 10 seconds, and less than or equal to 60 minutes. In one or more embodiments, the mixture comprising crude oil and feed water may have a residence time in the SCW unit of 10 seconds, 15 seconds, 20 seconds, 30 seconds, 40 seconds, 45 seconds, 50 seconds, 1 minute, 2 minutes, 5 minutes, 10 minutes, 15 minutes, 20 minutes, 30 minutes, 40 minutes, 45 minutes, 50 minutes, or 60 minutes. The residence time may be calculated by assuming the density of the fluid in the reactor has the density of water at reaction conditions.

In one or more embodiments, the mixture comprising crude oil and feed water may be in a turbulent flow regime with a Reynolds number greater than or equal to 3000. For example, the mixture comprising crude oil and feed water may be in a turbulent flow regime with a Reynolds number greater than or equal to 3000, 4000, 5000, 6000, 7000, 8000, 9000, 10,000, 11,000, 12,000, 13,000, 14,000, 15,000, 16,000, 17,000, 18,000, 19,000, 20,000, 25,000, 50,000, 75,000, or 100,000. The Reynolds number may be calculated by assuming the density of the fluid in the reactor has the density of water at reaction condition.

In one or more embodiments, the feed water and crude oil may have a flow rate ratio of from 1:10 to 1:0.1 at standard ambient temperature and pressure (SATP). In one or more embodiments, the feed water and crude oil may have a flow rate of from 1:10 to 1:0.1, 1:8 to 1:0.1, 1:6 to 1:0.1, 1:5 to 1:0.1, 1:4 to 1:0.1, 1:2 to 1:0.1, 1:1 to 1:0.1, 1:0.8 to 1:0.1, 1:0.6 to 1:0.1, 1:0.5 to 1:0.1, 1:0.4 to 1:0.1, 1:0.2 to 1:0.1, 1:10 to 1:0.2, 1:8 to 1:0.2, 1:6 to 1:0.2, 1:5 to 1:0.2, 1:4 to 1:0.2, 1:2 to 1:0.2, 1:1 to 1:0.2, 1:0.8 to 1:0.2, 1:0.6 to 1:0.2, 1:0.5 to 1:0.2, 1:0.4 to 1:0.2, 1:10 to 1:0.4, 1:8 to 1:0.4, 1:6 to 1:0.4, 1:5 to 1:0.4, 1:4 to 1:0.4, 1:2 to 1:0.4, 1:1 to 1:0.4, 1:0.8 to 1:0.4, 1:0.6 to 1:0.4, 1:0.5 to 1:0.4, 1:10 to 1:0.6, 1:8 to 1:0.6, 1:6 to 1:0.6, 1:5 to 1:0.6, 1:4 to 1:0.6, 1:2 to 1:0.6, 1:1 to 1:0.6, 1:0.8 to 1:0.6, 1:10 to 1:0.8, 1:8 to 1:0.8, 1:6 to 1:0.8, 1:4 to 1:0.8, 1:2 to 1:0.8, 1:1 to 1:0.8, 1:10 to 1:1, 1:8 to 1:1, 1:6 to 1:1, 1:5 to 1:1, 1:4 to 1:1, 1:2 to 1:1, 1:10 to 1:2, 1:8 to 1:2, 1:6 to 1:2, 1:5 to 1:2, 1:4 to 1:2, 1:10 to 1:4, 1:8 to 1:4, 1:6 to 1:4, 1:5 to 1:4, 1:10 to 1:6, 1:8 to 1:6, 1:10 to 1:8, or any combination thereof, at SATP.

In one or more embodiments, the process may comprise combining crude oil 130 and feed water 120 in the SCW unit 200 to produce a first upgraded output 220. In one or more embodiments, the first upgraded output 220 may pass through a cooler. In one or more embodiments, the cooler may cool the first upgraded output 220 to a temperature of greater than or equal to 50° C. and less than or equal to 350° C. In one or more embodiments, the cooler may cool the first upgraded output 220 to a temperature between 50 to 350° C., 100 to 350° C., 150 to 350° C., 200 to 350° C., 250 to 350° C., 300 to 350° C., 50 to 300° C., 100 to 300° C., 150 to 300° C., 200 to 300° C., 250 to 300° C., 50 to 250° C., 100 to 250° C., 150 to 250° C., 200 to 250° C., 50 to 200° C., 100 to 200° C., 150 to 200° C., 50 to 150° C., 100 to 150° C., 50 to 100° C., or any combination thereof.

In one or more embodiments, the first upgraded output 220 may pass through a depressurizer. In one or more embodiments, the depressurizer may depressurize the first upgraded output to a pressure of greater than or equal to 0.1 MPa and less than or equal to 1 MPa. In one or more embodiments, the depressurizer may depressurize the first upgraded output to a pressure between 0.1 to 1 MPa, 0.2 to 1 MPa, 0.5 to 1 MPa, or any combination thereof. In one or more embodiments, the first upgraded output 220 may pass through both a cooler and a depressurizer.

Referring again to FIG. 1, in one or more embodiments, the SCW unit 200 may operate at a pressure greater than a critical pressure of water and a temperature greater than a critical temperature of water. In one or more embodiments, the SCW unit may comprise at least one metered pump, at least one preheater, at least one reactor, at least one cooler, and at least one let-down device. In one or more embodiments, the volume of the reactor may be selected by determining the desired residence time of the mixture comprising crude oil and feed water in the SCW unit 200 (assuming the internal fluid is 100% water). In one or more embodiments, the SCW reactor may be arranged to be horizontal, vertical, inclined, declined, or combined.

In one or more embodiments, the SCW unit 200 may be operated at a temperature of greater than or equal to 374° C. In one or more embodiments, the SCW unit 200 may be operated at a temperature of between 374 to 600° C., 380 to 600° C., 390 to 600° C., 400 to 600° C., 425 to 600° C., 450 to 600° C., 460 to 600° C., 475 to 600° C., 500 to 600° C., 550 to 600° C., 374 to 550° C., 380 to 550° C., 390 to 550° C., 400 to 550° C., 425 to 550° C., 450 to 550° C., 460 to 550° C., 475 to 550° C., 500 to 550° C., 374 to 500° C., 380 to 500° C., 390 to 500° C., 400 to 500° C., 425 to 500° C., 450 to 500° C., 460 to 500° C., 475 to 500° C., 374 to 475° C., 380 to 475° C., 390 to 475° C., 400 to 475° C., 425 to 475° C., 450 to 475° C., 460 to 475° C., 374 to 460° C., 380 to 460° C., 390 to 460° C., 400 to 460° C., 425 to 460° C., 450 to 460° C., 374 to 450° C., 380 to 450° C., 390 to 450° C., 400 to 450° C., 425 to 450° C., 374 to 425° C., 380 to 425° C., 390 to 425° C., 400 to 425° C., 374 to 400° C., 380 to 400° C., 390 to 400° C., 374 to 390° C., 380 to 390° C., 374 to 380° C., or any combination thereof.

Without being bound by theory, the high temperature of the supercritical water environment is believed to be sufficient to get meaningful catalytic activity from low concentrations of salt, including alkali metal salts, alkaline earth metal salts, or combinations thereof. For example, concentrations as low as 500 to 3000 ppm (parts per million) by weight may be sufficient to get meaningful catalytic activity under supercritical water conditions. However, controlling such low concentrations of salt can be difficult in industrial application, as a sudden increase in salt concentration may cause salt to precipitate on to reactor walls and may cause plugs in process lines.

In one or more embodiments, the SCW unit 200 may be operated at a pressure of greater than or equal to 21 MPa. In one or more embodiments, the SCW unit 200 may be operated at a pressure of 21 to 35 MPa, 22 to 35 MPa, 23 to 35 MPa, 25 to 35 MPa, 30 to 35 MPa, 21 to 30 MPa, 22 to 30 MPa, 23 to 30 MPa, 25 to 30 MPa, 21 to 25 MPa, 22 to 25 MPa, 23 to 25 MPa, or any combination thereof.

In one or more embodiments, cracking, dealkylation, isomerization, alkylation, condensation, ring opening, cyclization, dehydrogenation, hydrogenation, and dimerization reactions may occur in the SCW unit 200. In one or more embodiments, cracking may be the dominant reaction that occurs in the SCW unit 200. In one or more embodiments, olefins may be formed in the SCW unit 200.

In one or more embodiments, the process may further comprise separating the first upgraded output 220 in a gas-water-oil separator 300 to produce a first gas effluent 320, a first water effluent 330, and a first oil effluent 340. In one or more embodiments, the first water effluent 330 may comprise inorganic impurities. For example, the first water effluent 330 may comprise organic and inorganic impurities originating from the crude oil 130, the feed water 120, or contaminants such as metals from inside the SCW unit 200. In one or more embodiments, the process may further comprise separating the first water effluent 330 in a first water treatment unit 400 to produce a rejected water stream 420 and a recycle water stream 430.

In one or more embodiments, the first gas-water-oil separator 300, may separate the first upgraded output 220, to produce a first gas effluent 320, a first water effluent 330, and a first oil effluent 340. In embodiments, the first gas-water-oil separator 300 may be operated at a temperature below 100° C. and a pressure below 1 MPa. In one or more embodiments, the first gas-water-oil separator 300 may be operated at a temperature of from 20 to 100° C., from 20 to 90° C., from 20 to 80° C., from 20 to 70° C., from 20 to 55° C., from 20 to 45° C., from 20 to 35° C., or any combination thereof. In one of more embodiments, the first gas-water-oil separator 300 may be operated at a pressure of from 0.01 to 0.5 MPa, from 0.01 to 0.25 MPa, from 0.01 to 0.1 MP a, from 0.01 to 0.05 MPa, or any combination thereof.

In one or more embodiment, the first gas effluent 320 may comprise $H_2$, $H_2O$, CO, $CO_2$, $H_2S$, $NH_3$, $C_1$ hydrocarbons, $C_2$ hydrocarbons, $C_3$ hydrocarbons, $C_4$ hydrocarbons, $C_5$ hydrocarbons, $C_6$ hydrocarbons, or combinations thereof. In one or more embodiments, the first gas effluent 320 may comprise 0.9% $H_2$, 1.0% CO, 1.1% $CO_2$, 14.0% $H_2S$, 10.2% $C_1$ hydrocarbons, 17.2% $C_2$ hydrocarbons, 17.7% $C_3$ hydrocarbons, 20.7% $C_4$ hydrocarbons, 11.0% $C_5$ hydrocarbons, and 1.0% $C_6$ hydrocarbons. In one or more embodiments, the first gas effluent 320 may comprise 0 to 5% $H_2$, 0 to 10% $H_2O$, 0 to 5% CO, 0 to 5% $CO_2$, 0 to 25% $H_2S$, 0 to 25% $NH_3$, 0 to 25% $C_1$ hydrocarbons, 0 to 50% $C_2$ hydrocarbons, 0 to 50% $C_3$ hydrocarbons, 0 to 60% $C_4$ hydrocarbons, 0 to 25% $C_5$ hydrocarbons, and 0 to 5% $C_6$ hydrocarbons.

In one or more embodiments, the first water effluent 330 may comprise dissolved hydrocarbons and metal compounds, including alkali metal compounds and alkaline earth metal compounds, that originated from the crude oil, feed water, metallic parts of the system or combinations thereof. In one or more embodiments, the first oil effluent 340 may have a lower density, a higher aromaticity, a lower amount of heavy fraction, a higher amount of light fraction, a lower amount of asphaltene, a lower amount of heteroatoms such as sulfur, nitrogen, and oxygen, and a lower amount of metals, than the crude oil 120. In one or more embodiments, the first oil effluent may comprise up to 1% water be weight.

In one or more embodiments, the first oil effluent may be pressurized by a pump. In one or more embodiments, the pump may pressurize the first oil effluent to a pressure equal to the pressure of the NCW unit. In one or more embodiments, the first oil effluent may be heated. In one or more embodiments, the first oil effluent may be both pressurized and heated. In one or more embodiments, the first oil effluent may be heated to greater than or equal to 50° C. and less than or equal to 200° C. In one or more embodiments, the first oil effluent may be heated to between 50 to 200° C., 75 to 200° C., 100 to 200° C., 125 to 200° C., 150 to 200° C., 175 to 200° C., 50 to 175° C., 75 to 175° C., 100 to 175° C., 125 to 175° C., 150 to 175° C., 50 to 150° C., 75 to 150° C., 100 to 150° C., 125 to 150° C., 50 to 125° C., 75 to 125° C., 100 to 125° C., 50 to 100° C., 75 to 100° C., 50 to 75° C., or any combination thereof.

In one or more embodiments, the process may further comprise combining raw water 150 with the first water effluent 330 before the first water effluent 330 is separated in the first water treatment unit 400. In one or more embodiments, the amount of raw water 150 added may be selected based on the concentration of alkali metals, alkaline earth metals, or combinations thereof desired in the rejected water steam 420. In one or more embodiments, combining the raw water 150 with the first water effluent 330 before the first water effluent 330 is separated in the first water treatment unit 400 may control the alkali metal and alkaline earth metal concentration in the rejected water stream 420.

In one or more embodiments, the raw water 150 has a salinity defined by a conductivity from 10 to 1500 μS/cm. In one or more embodiments, the raw water may have a salinity defined by a conductivity of from 10 to 1500 μS/cm, 25 to 1500 μS/cm, 50 to 1500 μS/cm, 100 to 1500 μS/cm, 200 to 1500 μS/cm, 250 to 1500 μS/cm, 500 to 1500 μS/cm, 750 to 1500 μS/cm, 1000 to 1500 μS/cm, 1250 to 1500 μS/cm, 10 to 1250 μS/cm, 25 to 1250 μS/cm, 50 to 1250 μS/cm, 100 to 1250 μS/cm, 200 to 1250 μS/cm, 250 to 1250 μS/cm, 500 to 1250 μS/cm, 750 to 1250 μS/cm, 1000 to 1250 μS/cm, 10 to 1000 μS/cm, 25 to 1000 μS/cm, 50 to 1000 μS/cm, 100 to 1000 μS/cm, 200 to 1000 μS/cm, 250 to 1000 μS/cm, 500 to 1000 μS/cm, 750 to 1000 μS/cm, 10 to 750 μS/cm, 25 to 750 μS/cm, 50 to 750 μS/cm, 100 to 750 μS/cm, 200 to 750 μS/cm, 250 to 750 μS/cm, 500 to 750 μS/cm, 10 to 500 μS/cm, 25 to 500 μS/cm, 50 to 500 μS/cm, 100 to 500 μS/cm, 200 to 500 μS/cm, 250 to 500 μS/cm, 10 to 250 μS/cm, 25 to 250 μS/cm, 50 to 250 μS/cm, 100 to 250 μS/cm, 200 to 250 μS/cm, 10 to 200 μS/cm, 25 to 200 μS/cm, 50 to 200 μS/cm, 100 to 200 μS/cm, 10 to 100 μS/cm, 25 to 100 μS/cm, 50 to 100 μS/cm, 10 to 50 μS/cm, 25 to 50 μS/cm, 10 to 25 μS/cm, or any combination thereof.

In one or more embodiments, the first water treatment unit 400 may separate the first water effluent 330 to produce a rejected water stream 420 and a recycle water stream 430.

In one or more embodiments, the recycle water stream 430 may have a salinity defined by a conductivity of less than or equal to 2 μS/cm. In one or more embodiments, the recycle water stream 430 may have a salinity defined by a conductivity of less than or equal to 2 μS/cm, 1.5 μS/cm, 1 μS/cm, 0.75 μS/cm, 0.5 μS/cm, 0.25 μS/cm, or 0.1 μS/cm.

In one or more embodiments, the system for upgrading crude oil may further comprise recycling at least a portion of the recycle water stream 430 for use as feed water 120. In one or more embodiments, the recycle water stream 430 may have the same properties as the feed water 120.

In one or more embodiments, the rejected water stream 420 may have a salinity defined by a conductivity from 10 to 1500 μS/cm. In one or more embodiments, the rejected water stream may have a combined alkali metal and alkaline earth metal concentration from 500 to 15,000 ppm by weight. In one or more embodiments, the rejected water stream may have, by weight, a combined alkali metal and alkaline earth metal concentration from 500 to 15,000 ppm, 1000 to 15,000 ppm, 1500 to 15,000 ppm, 2000 to 15,000 ppm, 2500 to 15,000 ppm, 3000 to 15,000 ppm, 5000 to 15,000 ppm, 7500 to 15,000 ppm, 10,000 to 15,000 ppm, 12,500 to 15,000 ppm, 500 to 12,500 ppm, 1000 to 12,500 ppm, 1500 to 12,500 ppm, 2000 to 12,500 ppm, 2500 to 12,500 ppm, 3000 to 12,500 ppm, 5000 to 12,500 ppm, 7500 to 12,500 ppm, 10,000 to 12,500 ppm, 500 to 10,000 ppm, 1000 to 10,000 ppm, 1500 to 10,000 ppm, 2000 to 10,000 ppm, 2500 to 10,000 ppm, 3000 to 10,000 ppm, 5000 to 10,000 ppm, 7500 to 10,000 ppm, 500 to 7500 ppm, 1000 to 7500 ppm, 1500 to 7500 ppm, 2000 to 7500 ppm, 2500 to 7500 ppm, 3000 to 7500 ppm, 5000 to 7500 ppm, 500 to 5000 ppm, 1000 to 5000 ppm, 1500 to 5000 ppm, 2000 to 5000 ppm, 2500 to 5000 ppm, 3000 to 5000 ppm, 500 to 3000 ppm, 1000 to 3000 ppm, 1500 to 3000 ppm, 2000 to 3000 ppm, 2500 to 3000 ppm, 500 to 2500 ppm, 1000 to 2500 ppm, 1500 to 2500 ppm, 2000 to 2500 ppm, 500 to 2000 ppm, 1000 to 2000 ppm, 1500 to 2000 ppm, 500 to 1500 ppm, 1000 to 1500 ppm, 500 to 1000 ppm, or any combination thereof.

In one or more embodiments, the rejected water stream may comprise 500 to 600 mg/L total dissolved solids (TD S). In one or more embodiments, the rejected water stream may comprise TDS in a concentration of 500 to 600 mg/L, 525 to 600 mg/L, 550 to 600 mg/L, 575 to 600 mg/L, 500 to 575 mg/L, 525 to 575 mg/L, 550 to 575 mg/L, 500 to 550 mg/L, 525 to 550 mg/L, 550 to 525 mg/L, or any combination thereof.

In one or more embodiments, the rejected water stream 420 may comprise impurities. In one more embodiments, the rejected water stream 420 may comprise alkali metals, alkaline earth metals, or combinations thereof. In one or more embodiments, the alkali metals, alkaline earth metals, or combinations thereof may have low solubility in super critical water. In one or more embodiments, the alkali metals, alkaline earth metals, or combinations thereof may act as homogeneous catalysts. In one or more embodiments, the alkali metals, alkaline earth metals, or combinations thereof may act as homogeneous catalysts in the NCW unit 500.

Without being bound by theory, it is believed that the presence of alkali metals, alkaline earth metals, or combinations thereof may accelerate carbon-heteroatom bond hydrolysis, and thus may accelerate reactions such as de sulfurization, denitrogenation, or deoxygenation. The solubility of alkali metals, alkaline earth metals, or combinations or salts thereof depends on the temperature and pressure of water. Alkali metals, alkaline earth metals, or combinations or salts thereof have low (but non-zero) solubility in supercritical water because the solubility relates to the density of supercritical water and the density relates to the dielectric constant of the supercritical water. However, alkali metals, alkaline earth metals, or combinations thereof have relatively high solubility and catalytic activity in nearcritical water. Thus, using nearcritical water, which has relatively high solubility and catalytic activity of salts, in conjunction with non-catalytic supercritical water, may prevent corrosion and process line plugging by minimizing catalyst precipitation while maximizing catalytic activity.

In one or more embodiments, the presence of alkali metals, alkaline earth metals, or combinations thereof may catalyze hydrolysis reactions that cleave carbon-heteroatom bonds, including, but not limited to, carbon-sulfur bonds. In one or more embodiments, the presence of alkali metals, alkaline earth metals, or combinations thereof may catalyze the hydration of olefins formed in the SCW unit to form alcohol. In one or more embodiments, a dehydration reactions may also occur when the olefins formed in the SCW unit are hydrated to form alcohol. In one or more embodiments, the hydrolysis reactions may result in a larger extent (or conversion) of desulfurization reactions.

In one or more embodiments, the rejected water stream 420 may have a salinity defined by a conductivity from 10 to 1500 μS/cm. In one or more embodiments, the rejected water stream 420 may have a salinity defined by a conductivity of from 10 to 1500 μS/cm, 25 to 1500 μS/cm, 50 to 1500 μS/cm, 100 to 1500 μS/cm, 200 to 1500 μS/cm, 250 to 1500 μS/cm, 500 to 1500 μS/cm, 750 to 1500 μS/cm, 1000 to 1500 μS/cm, 1250 to 1500 μS/cm, 10 to 1250 μS/cm, 25 to 1250 μS/cm, 50 to 1250 μS/cm, 100 to 1250 μS/cm, 200 to 1250 μS/cm, 250 to 1250 μS/cm, 500 to 1250 μS/cm, 750 to 1250 μS/cm, 1000 to 1250 μS/cm, 10 to 1000 μS/cm, 25 to 1000 μS/cm, 50 to 1000 μS/cm, 100 to 1000 μS/cm, 200 to 1000 μS/cm, 250 to 1000 μS/cm, 500 to 1000 μS/cm, 750 to 1000 μS/cm, 10 to 750 μS/cm, 25 to 750 μS/cm, 50 to 750 μS/cm, 100 to 750 μS/cm, 200 to 750 μS/cm, 250 to 750 μS/cm, 500 to 750 μS/cm, 10 to 500 μS/cm, 25 to 500 μS/cm, 50 to 500 μS/cm, 100 to 500 μS/cm, 200 to 500 μS/cm, 250 to 500 μS/cm, 10 to 250 μS/cm, 25 to 250 μS/cm, 50 to 250 μS/cm, 100 to 250 μS/cm, 200 to 250 μS/cm, 10 to 200 μS/cm, 25 to 200 μS/cm, 50 to 200 μS/cm, 100 to 200 μS/cm, 10 to 100 μS/cm, 25 to 100 μS/cm, 50 to 100 μS/cm, 10 to 50 μS/cm, 25 to 50 μS/cm, 10 to 25 μS/cm, or any combination thereof.

In one or more embodiments, the rejected water stream may be pressurized by a pump. In one or more embodiments, the pump may pressurize the rejected water stream to a pressure equal to the pressure of the NCW unit. In one or more embodiments, the rejected water stream may be heated. In one or more embodiments, the rejected water stream may be heated to greater than or equal to 50° C. and less than or equal to 200° C. In one or more embodiments, the rejected water stream may be heated to between 50 to 200° C., 75 to 200° C., 100 to 200° C., 125 to 200° C., 150 to 200° C., 175 to 200° C., 50 to 175° C., 75 to 175° C., 100 to 175° C., 125 to 175° C., 150 to 175° C., 50 to 150° C., 75 to 150° C., 100 to 150° C., 125 to 150° C., 50 to 125° C., 75 to 125° C., 100 to 125° C., 50 to 100° C., 75 to 100° C., 50 to 75° C., or any combination thereof. In one or more embodiments, the rejected water stream may be both heated and pressurized.

Referring again to FIG. 1, the process may further comprise combining the first oil effluent 340 and the rejected water stream 420 in a NCW unit 500 to produce a second upgraded output 520. In one or more embodiments, the NCW unit may operate at a pressure above 22 MPa and a temperature of 200 to 374° C. In one or more embodiments, the alkali metals, alkaline earth metals, or combinations thereof in the rejected water stream 420 may catalyze hydrolysis in the NCW unit 500.

Without being bound by theory, near critical water conditions are believed to help prevent catalyst decomposition and prevent corrosion and plugging of process lines. Hydrolysis is a reaction where water acts as a reagent. The properties of water change drastically near the critic al point, especially at pressures higher than steam pressure. Near the critical point, the dielectric constant and the density of water decrease with increasing temperature and remain low after the critical temperature of water (374° C.) is reached. The ionic product of water increases slowly with increasing temperature, but decreases sharply at the critical temperature of water (374° C.). For example, the ionic product of water between 200° C. and 350° C. reaches between $10^{-11}$ and $10^{-12}$, whereas the ionic product of water at ambient conditions (25° C., 0.1 MPa) is about $10^{-14}$. Without being bound by theory, it is believed that the higher ionic product of water at near critical water conditions may make near critical water a good reaction medium for acid or base catalyzed reactions. Hydrolysis reactions often require acid or base catalysts to produce meaningful amounts of products. Heteroatom-containing hydrocarbons may have higher activity in hydrolysis than pure hydrocarbons because carbon-heteroatom bonds (for example, carbon-sulfur bonds, carbon-nitrogen bonds, or carbon-oxygen bonds) have higher polarity than carbon-carbon bonds or carbon-hydrogen bonds.

In one or more embodiments, the NCW unit 500 may upgrade a mixture comprising the first oil effluent 340 and the rejected water stream 420 to produce a second upgraded output 520. In one or more embodiments, first oil effluent and the rejected water stream may be combined in a mixer to produce a mixture comprising oil effluent and rejected water feed. In one or more embodiments, the mixer may be selected from an agitator stirred tank, an ultrasonic-assisted mixing tank, other similar mixers, or combinations thereof. In one or more embodiments, the mixture comprising oil effluent and rejected water feed may be pressurized and heated. In one or more embodiments, the mixture comprising oil effluent and rejected water feed may be passed to NCW unit 500 to produce a second upgraded output 520.

In one or more embodiments, hydrolysis, hydration, dehydration, isomerization, and dimerization may occur in the NCW unit 500. In one or more embodiments, hydrolysis may be the dominant reaction that occurs in the NCW unit 500. In one or more embodiments, hydrolysis may cleave carbon-heteroatom bonds such as carbon-sulfur, carbon-nitrogen, and carbon-oxygen bonds. In one or more embodiments, olefins formed in the SCW unit 200 may be hydrated with water with the aid of alkali metal, alkaline earth metal, or combinations thereof acting as catalysts to form alcohol.

In one or more embodiments, the first oil effluent and the rejected water stream may have a residence time in the NCW unit of greater than or equal to 1 minute and less than or equal to 300 minutes. In one or more embodiments, the first oil effluent and the rejected water stream may have a residence time in the NCW unit in a range between 1 to 300 minutes, 30 to 300 minutes, 60 and 300 minutes, 90 and 300 minutes, 120 and 300 minutes, 180 and 300 minutes, 210 and 300 minutes, 240 and 300 minutes, 270 and 300 minutes, 1 to 270 minutes, 30 to 270 minutes, 60 and 270 minutes, 90 and 270 minutes, 120 and 270 minutes, 180 and 270 minutes, 210 and 270 minutes, 240 and 270 minutes, 1 to 240 minutes, 30 to 240 minutes, 60 and 240 minutes, 90 and 240 minutes, 120 and 240 minutes, 180 and 240 minutes, 210 and 240 minutes, 1 to 210 minutes, 30 to 210 minutes, 60 and 210 minutes, 90 and 210 minutes, 120 and 210 minutes, 180 and 210 minutes, 1 to 180 minutes, 30 to 180 minutes, 60 and 180 minutes, 90 and 180 minutes, 120 and 180 minutes, 1 to 120 minutes, 30 to 120 minutes, 60 and 120 minutes, 90 and 120 minutes, 1 to 90 minutes, 30 to 90 minutes, 60 and 90 minutes, 1 to 60 minutes, 30 to 60 minutes, 1 to 30 minutes, or any combination of ranges thereof.

In one or more embodiments, the ratio of the flow rate of the first oil effluent 340 to the flow rate of the rejected water stream 420 may be in the range of greater than or equal to 1:2 to less than or equal to 1:01 at SATP. In one or more embodiments, the ratio of the flow rate of the first oil effluent 340 to the flow rate of the rejected water stream 420 may be in the range between 1:2 to 1:0.1, 1:1 to 1:0.1, 1:0.8 to 1:0.1, 1:0.6 to 1:0.1, 1:0.5 to 1:0.1, 1:0.4 to 1:0.1, 1:0.2 to 1:0.1, 1:2 to 1:0.2, 1:1 to 1:0.2, 1:0.8 to 1:0.2, 1:0.6 to 1:0.2, 1:0.5 to 1:0.2, 1:0.4 to 1:0.2, 1:2 to 1:0.4, 1:1 to 1:0.4, 1:0.8 to 1:0.4, 1:0.6 to 1:0.4, 1:0.5 to 1:0.4, 1:2 to 1:0.6, 1:1 to 1:0.6, 1:0.8 to 1:0.6, 1:2 to 1:0.8, 1:1 to 1:0.8, 1:2 to 1:1, or any combination thereof at SATP.

In one or more embodiments, the NCW unit 500 may operate at a pressure of higher than or equal to 22 MPa and a temperature of 200 to 374° C. For example, the NCW unit may operate at a pressure of from 21 to 35 MPa, 22 to 35 MPa, 23 to 35 MPa, 25 to 35 MPa, 30 to 35 MPa, 21 to 30 MPa, 22 to 30 MPa, 23 to 30 MPa, 25 to 30 MPa, 21 to 25 MPa, 22 to 25 MPa, 23 to 25 MPa, or any combination of these ranges. For example, the NCW unit may operate at a temperature of 200 to 374° C., 250 to 374° C., 300 to 374° C., 350 to 374° C., 200 to 350° C., 250 to 350° C., 300 to 350° C., 200 to 300° C., 250 to 300° C., 200 to 250° C., or any combination of those ranges. In one or more embodiments, NCW unit operates at a pressure higher than steam pressure and a temperature that maintains water in a liquid phase. In one or more embodiments, the NCW unit may be a NCW reactor. In some embodiments, the NCW reactor may be a tubular reactor, pipe reactor, a continuous stirred-tank reactor (CSTR), or a combined reactor.

In one or more embodiments, the second upgraded output 520 may be cooled by a cooler. As would be familiar with the skilled person, the cooler may comprise various devices, such as a heat exchanger. In one or more embodiments, the second upgraded output may have a temperature greater than or equal to 20° C. and less than or equal to 80° C. In one or more embodiments, the second upgraded output may be depressurized by a depressurizer. In one or more embodiments, the second upgraded output may have a pressure below 1 MPa.

In one or more embodiments, the system for upgrading crude oil may further comprise a second gas-water-oil separator 600. In one or more embodiments, the second gas-water-oil separator 600 may be downstream from the NCW unit 500. In one or more embodiments, the process may further comprise separating the second upgraded output 520 in a second gas-water-oil separator 600 to produce a second gas effluent 620, a second water effluent 630, and a second oil effluent 640. In embodiments, the second gas-water-oil separator 600 may be operated at a temperature below 100° C. and a pressure below 1 MPa. In one or more embodiments, the second gas-water-oil separator 600 may be operated at a temperature of from 20 to 100° C., from 20 to 90° C., from 20 to 80° C., from 20 to 70° C., from 20 to 55° C., from 20 to 45° C., from 20 to 35° C., or any combination thereof. In one of more embodiments, the second gas-water-oil separator 600 may be operated at a pressure of from 0.01 to 0.5 MPa, from 0.01 to 0.25 MPa, from 0.01 to 0.1 MPa, from 0.01 to 0.05 MPa, or any combination thereof.

In one or more embodiments, the second gas effluent 620 may comprise $H_2$, $H_2O$, CO, $CO_2$, $H_2S$, $NH_3$, $C_1$ hydrocarbons, $C_2$ hydrocarbons, $C_3$ hydrocarbons, $C_4$ hydrocarbons, $C_5$ hydrocarbons, $C_6$ hydrocarbons, or combinations thereof. In one or more embodiments, the second gas effluent 620 may comprise 7.5% $H_2$, 21.9% $H_2O$, 6.3% CO, 12.6% $CO_2$, 2.4% $H_2S$, 15.6% $C_1$ hydrocarbons, 9.6% $C_2$ hydrocarbons, 12.0% $C_3$ hydrocarbons, 6.3% $C_4$ hydrocarbons, 3.3% $C_5$ hydrocarbons, and 2.4% $C_6$ hydrocarbons. In one or more embodiments, the second gas effluent 620 may comprise 0 to 10% $H_2$, 0 to 30% $H_2O$, 0 to 10% CO, 0 to 20% $CO_2$, 0 to 5% $H_2S$, 0 to 5% $NH_3$, 0 to 25% $C_1$ hydrocarbons, 0 to 25% $C_2$ hydrocarbons, 0 to 150% $C_3$ hydrocarbons, 0 to 150% $C_4$ hydrocarbons, 0 to 15% $C_5$ hydrocarbons, and 0 to 5% $C_6$ hydrocarbons.

In one or more embodiments, the second water effluent 630 may comprise alkali metals, alkali earth metals, dissolved organic compounds, or combinations thereof.

In one or more embodiments, the second oil effluent 640 may have a lower amount of impurities and a lower amount of heavy fraction than the first oil effluent 340. In one or more embodiments, the first oil effluent may comprise up to 1% water by weight.

In one or more embodiments, the system may further comprise a second water treatment unit 700. In one or more embodiments, the second water treatment unit 700 may be downstream from the second gas-water-oil separator 600. In one or more embodiments, the second water treatment unit 700 may separate the second water effluent 630 to produce a treated water stream 720 and a discharged water stream 730. In one or more embodiments, the discharge water stream 730 may undergo processing, further treatment, or disposal in a wastewater plant (not shown). In one or more embodiments, the process may further comprise passing at least a portion of the treated water stream 720 back to the first water treatment unit 400.

In one or more embodiments, at least a portion of the treated water stream 720 may be passed back to the first water treatment unit 400.

In one or more embodiments, the treated water stream may comprise a combined alkali metal and alkaline earth metal concentration of from 5 to 1,200 ppm by weight. In one or more embodiments, the treated water stream may comprise a combined alkali metal and alkaline earth metal concentration, by weight of from 5 to 1,200 ppm, 10 to 1,200 ppm, 25 to 1,200 ppm, 50 to 1,200 ppm, 75 to 1,200 ppm, 100 to 1,200 ppm, 200 to 1,200 ppm, 250 to 1,200 ppm, 500 to 1,200 ppm, 750 to 1,200 ppm, 1,000 to 1,200 ppm, 1,100 to 1,200 ppm, 5 to 1,100 ppm, 10 to 1,100 ppm, 25 to 1,100 ppm, 50 to 1,100 ppm, 75 to 1,100 ppm, 100 to 1,100 ppm, 200 to 1,100 ppm, 250 to 1,100 ppm, 500 to 1,100 ppm, 750 to 1,100 ppm, 1,000 to 1,100 ppm, 5 to 1,000 ppm, 10 to 1,000 ppm, 25 to 1,000 ppm, 50 to 1,000 ppm, 75 to 1,000 ppm, 100 to 1,000 ppm, 200 to 1,000 ppm, 250 to 1,000 ppm, 500 to 1,000 ppm, 750 to 1,000 ppm, 5 to 750 ppm, 10 to 750 ppm, 25 to 750 ppm, 50 to 750 ppm, 75 to 750 ppm, 100 to 750 ppm, 200 to 750 ppm, 250 to 750 ppm, 500 to 750 ppm, 5 to 500 ppm, 10 to 500 ppm, 25 to 500 ppm, 50 to 500 ppm, 75 to 500 ppm, 100 to 500 ppm, 200 to 500 ppm, 250 to 500 ppm, 5 to 250 ppm, 10 to 250 ppm, 25 to 250 ppm, 50 to 250 ppm, 75 to 250 ppm, 100 to 250 ppm, 200 to 250 ppm, 5 to 200 ppm, 10 to 200 ppm, 25 to 200 ppm, 50 to 200 ppm, 75 to 200 ppm, 100 to 200 ppm, 5 to 100 ppm, 10 to 100 ppm, 25 to 100 ppm, 50 to 100 ppm, 75 to 100 ppm, 5 to 75 ppm, 10 to 75 ppm, 25 to 75 ppm, 50 to 75 ppm, 5 to 50 ppm, 10 to 50 ppm, 25 to 50 ppm, 5 to 25 ppm, 10 to 25 ppm, 5 to 10 ppm, or any combination thereof.

In one or more embodiments, the treated water stream may comprise a conductivity of from 10 to 1,500 μS/cm. In one or more embodiments, the treated water stream may comprise a conductivity of from 10 to 1500 μS/cm, 25 to 1500 μS/cm, 50 to 1500 μS/cm, 100 to 1500 μS/cm, 200 to 1500 μS/cm, 250 to 1500 μS/cm, 500 to 1500 μS/cm, 750 to 1500 μS/cm, 1000 to 1500 μS/cm, 1250 to 1500 μS/cm, 10 to 1250 μS/cm, 25 to 1250 μS/cm, 50 to 1250 μS/cm, 100 to 1250 μS/cm, 200 to 1250 μS/cm, 250 to 1250 μS/cm, 500 to 1250 μS/cm, 750 to 1250 μS/cm, 1000 to 1250 μS/cm, 10 to 1000 μS/cm, 25 to 1000 μS/cm, 50 to 1000 μS/cm, 100 to 1000 μS/cm, 200 to 1000 μS/cm, 250 to 1000 μS/cm, 500 to 1000 μS/cm, 750 to 1000 μS/cm, 10 to 750 μS/cm, 25 to 750 μS/cm, 50 to 750 μS/cm, 100 to 750 μS/cm, 200 to 750 μS/cm, 250 to 750 μS/cm, 500 to 750 μS/cm, 10 to 500 μS/cm, 25 to 500 μS/cm, 50 to 500 μS/cm, 100 to 500 μS/cm, 200 to 500 μS/cm, 250 to 500 μS/cm, 10 to 250 μS/cm, 25 to 250 μS/cm, 50 to 250 μS/cm, 100 to 250 μS/cm, 200 to 250 μS/cm, 10 to 200 μS/cm, 25 to 200 μS/cm, 50 to 200 μS/cm, 100 to 200 μS/cm, 10 to 100 μS/cm, 25 to 100 μS/cm, 50 to 100 μS/cm, 10 to 50 μS/cm, 25 to 50 μS/cm, 10 to 25 μS/cm, or any combination thereof.

In one or more embodiments, the treated water stream may comprise from 5 to 300 mg/L total dissolved solid (TDS). In one or more embodiments, the treated water stream may comprise from 5 to 300 mg/L, 10 to 300 mg/L, 25 to 300 mg/L, 50 to 300 mg/L, 75 to 300 mg/L, 100 to 300 mg/L, 150 to 300 mg/L, 200 to 300 mg/L, 250 to 300 mg/L, 5 to 250 mg/L, 10 to 250 mg/L, 25 to 250 mg/L, 50 to 250 mg/L, 75 to 250 mg/L, 100 to 250 mg/L, 150 to 250 mg/L, 200 to 250 mg/L, 5 to 200 mg/L, 10 to 200 mg/L, 25 to 200 mg/L, 50 to 200 mg/L, 75 to 200 mg/L, 100 to 200 mg/L, 150 to 200 mg/L, 5 to 150 mg/L, 10 to 150 mg/L, 25 to 150 mg/L, 50 to 150 mg/L, 75 to 150 mg/L, 100 to 150 mg/L, 5 to 100 mg/L, 10 to 100 mg/L, 25 to 100 mg/L, 50 to 100 mg/L, 75 to 100 mg/L, 5 to 75 mg/L, 10 to 75 mg/L, 25 to 75 mg/L, 50 to 75 mg/L, 5 to 50 mg/L, 10 to 50 mg/L, 25 to 50 mg/L, 5 to 25 mg/L, 10 to 25 mg/L, 5 to 10 mg/L, or any combination thereof.

In one or more embodiments, the treated water stream may comprise the same propertie s as raw water.

Figure 2:
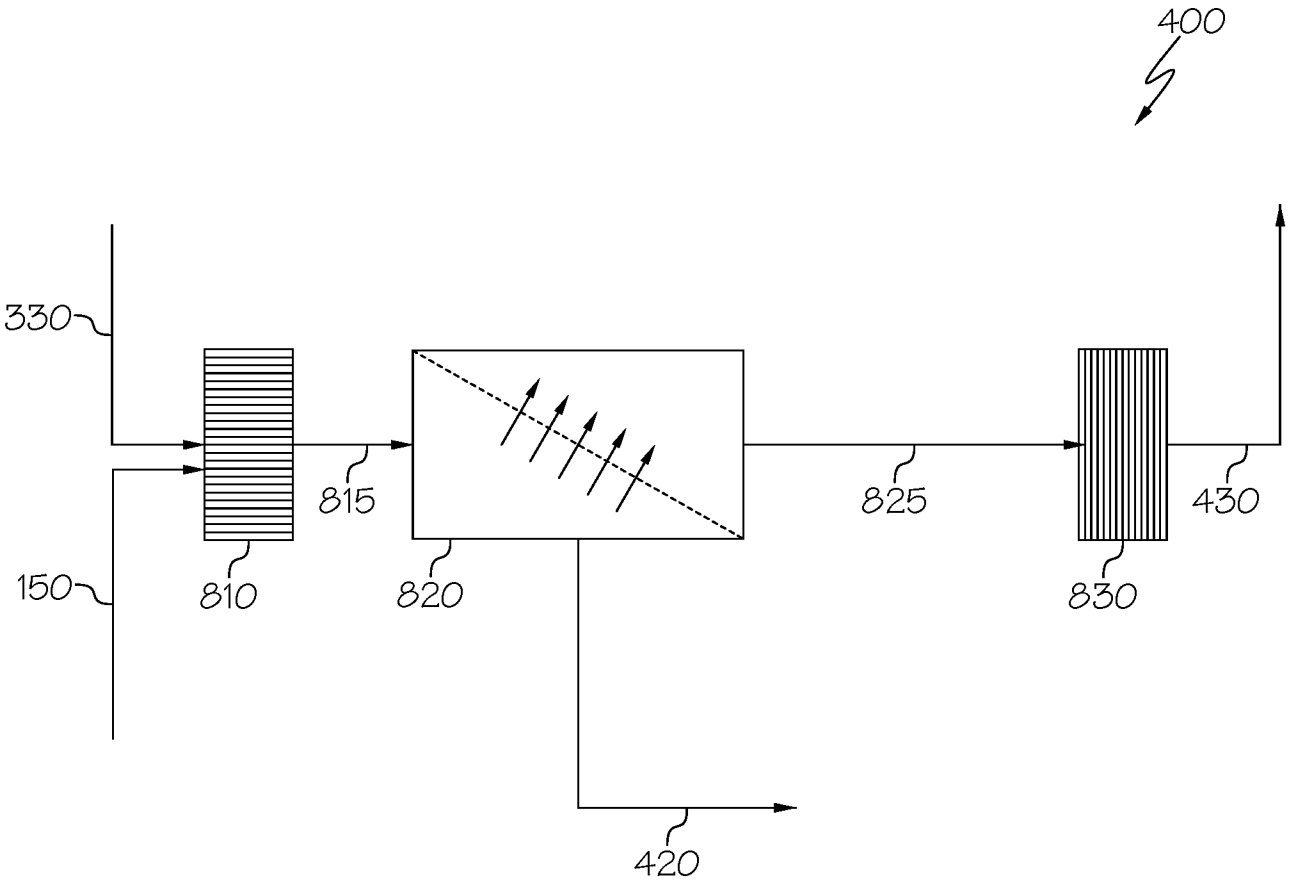
FIG. 2 illustrates a schematic view of an example process for separating a first water effluent in a first water treatment unit.

Referring now to FIG. 2, a schematic view of an example process for separating a first water effluent 330 in a first water treatment unit 400 is shown. In one or more embodiments, the first water treatment unit 400 may receive the first water effluent 330 at a flow rate of 1462.8 tonnes per day (tonne/d). In one or more embodiments, the first water treatment unit may operate at a pressure of 0.973 MPa.

In one or more embodiments, separating the first water effluent 330 in a first water treatment unit 400 may comprise passing the first water effluent 330 through at least one pre-filter 810 to produce a first pre-filtered effluent 815. In one or more embodiments, at least two pre-filters 810 may be arranged in series, in parallel, or combinations thereof. In one or more embodiments, the at least one pre-filter 810 may be regenerated by back-flushing with clean water, solvent cleaning, other similar methods, or combinations thereof. In one or more embodiments, passing the first water effluent 330 through at least one pre-filter 810 may remove solid particles, coagulated oils such as oil-water emulsion, or combinations thereof. In one or more embodiments, the at least one pre-filter 810 may be a polypropylene spun filter cartridge, a polypropylene wound filter cartridge, a polypropylene pleated filter cartridge, a polytetrafluoroethylene (PTFE) pleated filter cartridge, a resin bonded filter cartridge, a stainless steel filter cartridge, or combinations thereof.

In one or more embodiments, the first pre-filtered effluent 815 may then be passed through at least one impurity partitioning membrane 820 to produce a rejected water stream 420 and a first purified water effluent 825. In one or more embodiments, the first purified water effluent 825 may have a lower dissolved organic compound content, a lower conductivity, and a lower salt content than the rejected water stream 420. In one or more embodiments, the water quality and the flow rate of the first purified water effluent 825 and the rejected water stream 420 may be controlled by changing the at least one impurity partitioning membrane 820 membrane area, number of stages, number of passes, presence of a booster pump, water recovery, or any combination thereof. In one or more embodiments, more stages of the at least one impurity partitioning membrane 820 may result in greater recovery of the first purified water effluent 825. In one or more embodiments, more passes through the at least one impurity partitioning membrane 820 may improve the quality of the first purified water effluent 825.

In one or more embodiments, the at least one impurity partitioning membrane 820 may utilize a membrane-based demineralization process. In one or more embodiments, the at least one impurity partitioning membrane 820 may be selected based on its water flux and salt rejection capacity. For example, the at least one impurity partitioning membrane 820 may be a reverse osmosis (RO) membrane, including brackish water RO membranes and seawater RO membranes, a nanofiltration (NF) membrane, other similar membranes, or combinations thereof. Various compositions are considered suitable for the impurity partitioning membrane 820. In one or more embodiments, the at least one impurity partitioning membrane 820 may be an aromatic polyamide thin film composite spiral wound membrane or a cellulose-based hollow fiber membrane. In one or more embodiments, the at least one impurity partitioning membrane 820 may have a monovalent salt rejection rate in the range of 50 to 99% by volume. In one or more embodiments, the at least one impurity partitioning membrane 820 may have a monovalent salt rejection rate, by volume, in the range of 50 to 99%, 60 to 99%, 70 to 99%, 75 to 99%, 80 to 99%, 85 to 99%, 90 to 99%, 95 to 99%, 50 to 95%, 60 to 95%, 70 to 95%, 75 to 95%, 80 to 95%, 85 to 95%, 90 to 95%, 50 to 90%, 60 to 90%, 70 to 90%, 75 to 90%, 80 to 90%, 85 to 90%, 50 to 85%, 60 to 85%, 70 to 85%, 75 to 85%, 80 to 85%, 50 to 80%, 60 to 80%, 70 to 80%, 75 to 80%, 50 to 75%, 60 to 75%, 70 to 75%, 50 to 70%, 60 to 70%, 50 to 60%, or any combination thereof.

In one or more embodiments, the first purified water effluent 825 may be passed through a polisher 830 to produce a recycle water stream 430. In one of more embodiments, the polisher 830 may be an ion exchange resin, an electrodialysis (EDI) unit, a mixed bed polisher (MBP), or combinations thereof. In one or more embodiments, the polisher 830 may decrease the conductivity, the amount of ionic compounds, or combinations thereof, in the recycle water stream 430. In one or more embodiments (not shown in FIG. 2), the first purified water effluent 825 may be directly utilized as recycle water stream 430.

Without being bound by theory, it is believed that pre-filtering the first water effluent 330 may protect the at least one impurity partitioning membrane 820 and improve the performance of the first water treatment unit 400.

Figure 3:
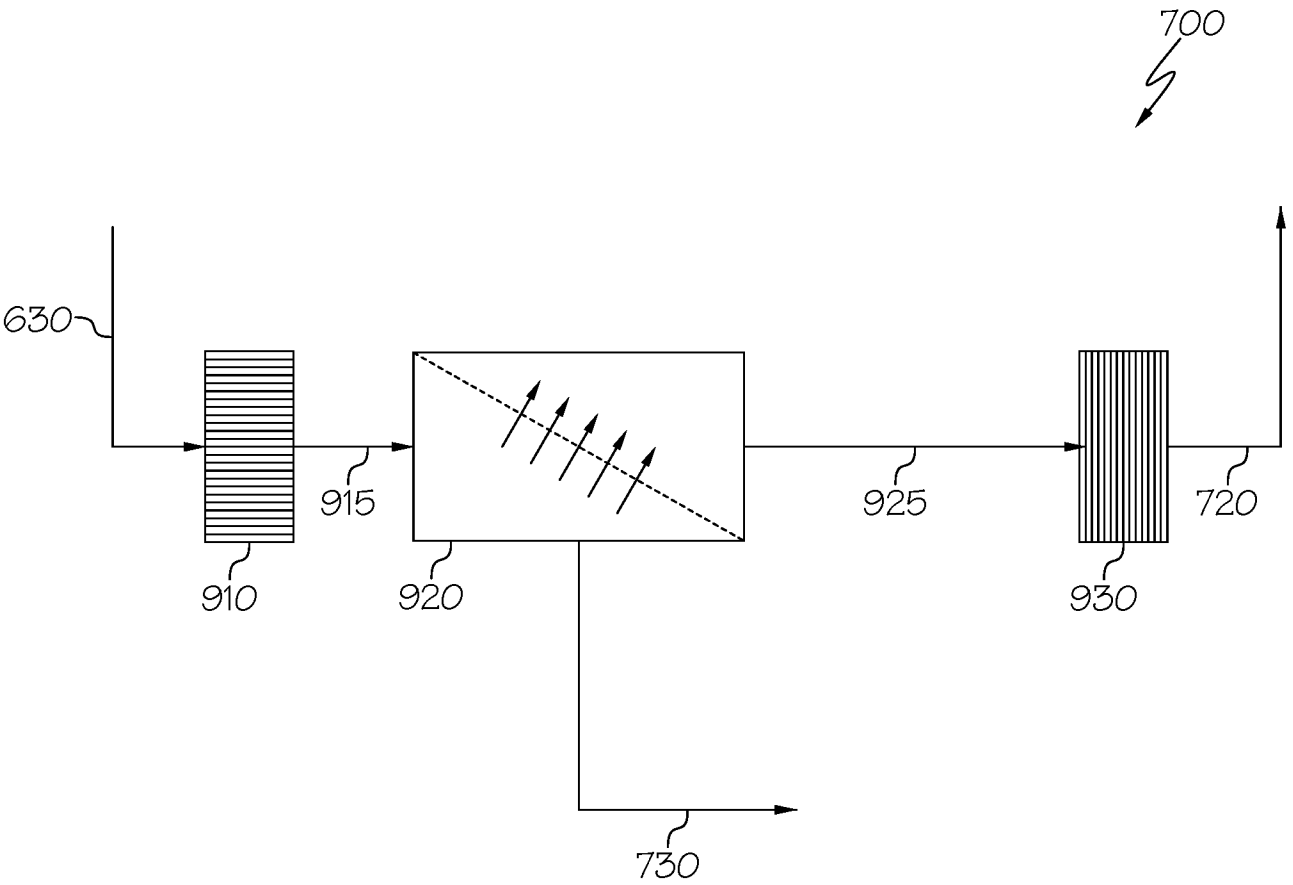
FIG. 3 illustrates a schematic view of an example process for separating a second water effluent in a second water treatment unit.

Referring now to FIG. 3, a schematic view of an example process for separating a second water effluent 630 in a second water treatment unit 700 is shown. In one or more embodiments, separating the second water effluent 630 in a second water treatment unit 700 may comprise passing the second water effluent 630 through at least one pre-filter 910 to produce a second pre-filtered effluent 915. In one or more embodiments, at least two pre-filters 910 may be arranged in series, in parallel, or combinations thereof. In one or more embodiments, the at least one pre-filter 910 may be regenerated by back-flushing with clean water, solvent cleaning, other similar methods, or combinations thereof. In one or more embodiments, passing the second water effluent 630 through at least one pre-filter 910 may remove solid particles, coagulated oils such as oil-water emulsion, or combinations thereof. In one or more embodiments, the at least one pre-filter 910 may be a polypropylene spun filter cartridge, a polypropylene wound filter cartridge, a polypropylene pleated filter cartridge, a polytetrafluoroethylene (PTFE) pleated filter cartridge, a resin bonded filter cartridge, a stainless steel filter cartridge, or combinations thereof.

In one or more embodiments, the second pre-filtered effluent 915 may then be passed through at least one impurity partitioning membrane 920 to produce a discharge water stream 730 and a second purified water effluent 925. In one or more embodiments, the at least one impurity partitioning membrane 920 may utilize a membrane-based demineralization process. In one or more embodiments, the at least one impurity partitioning membrane 920 may be an aromatic polyamide thin film composite spiral wound membrane or a cellulose-based hollow fiber membrane. In one or more embodiments, the at least one impurity partitioning membrane 920 may be selected based on its water flux and salt rejection capacity. In one or more embodiments, the at least one impurity partitioning membrane 920 may be a reverse osmosis (RO) membrane, a nanofiltration (NF) membrane, other similar membranes, or combinations thereof. In one or more embodiments, the at least one impurity partitioning membrane 920 may have a monovalent salt rejection rate in the range of 50 to 99% by volume. In one or more embodiments, the at least one impurity partitioning membrane 920 may have a monovalent salt rejection rate, by volume, in the range of 50 to 99%, 60 to 99%, 70 to 99%, 75 to 99%, 80 to 99%, 85 to 99%, 90 to 99%, 95 to 99%, 50 to 95%, 60 to 95%, 70 to 95%, 75 to 95%, 80 to 95%, 85 to 95%, 90 to 95%, 50 to 90%, 60 to 90%, 70 to 90%, 75 to 90%, 80 to 90%, 85 to 90%, 50 to 85%, 60 to 85%, 70 to 85%, 75 to 85%, 80 to 85%, 50 to 80%, 60 to 80%, 70 to 80%, 75 to 80%, 50 to 75%, 60 to 75%, 70 to 75%, 50 to 70%, 60 to 70%, 50 to 60%, or any combination thereof.

In one or more embodiments, second purified water effluent 925 may have a lower dissolved organic compound content, a lower conductivity, and a lower salt content than the a discharge water stream 730. In one or more embodiments, the water quality and the flow rate of the second purified water effluent 925 and the discharge water stream 730 may be controlled by changing the at least one impurity partitioning membrane 920 membrane area, number of stages, number of passes, presence of a booster pump, water recovery, or any combination thereof. In one or more embodiments, more stages of the at least one impurity partitioning membrane 920 may result in greater recovery of the second purified water effluent 925. In one or more embodiments, more passes through the at least one impurity partitioning membrane 920 may improve the quality of the second purified water effluent 925.

In one or more embodiments, the second purified water effluent 925 may be passed through a polisher 930 to produce a treated water stream 720. In one or more embodiments, the second purified water effluent 925 may be passed through a polisher 930 to produce a treated water stream 720. In one of more embodiments, the polisher 930 may be an ion exchange resin, an electrodialysis (EDI) unit, a mixed bed polisher (MBP), or combinations thereof. In one or more embodiments, the polisher 930 may decrease the conductivity, the amount of ionic compounds, or combinations thereof, in the treated water stream 720. In one or more embodiments (not shown in FIG. 3), the second purified water effluent 925 may be directly utilized as treated water stream 720.

Without being bound by theory, it is believed that pre-filtering the second water effluent 630 may protect the at least one impurity partitioning filter 920 and improve the performance of the first water treatment unit 700.

EXAMPLES

The various embodiments of processes and systems for upgrading crude oil will be further clarified by the following examples. The examples are illustrative in nature, and should not be understood to limit the subject matter of the present disclosure.

Comparative Example

A computer simulation using Aspen HYSYS was used to generate the following results.

Figure 4:
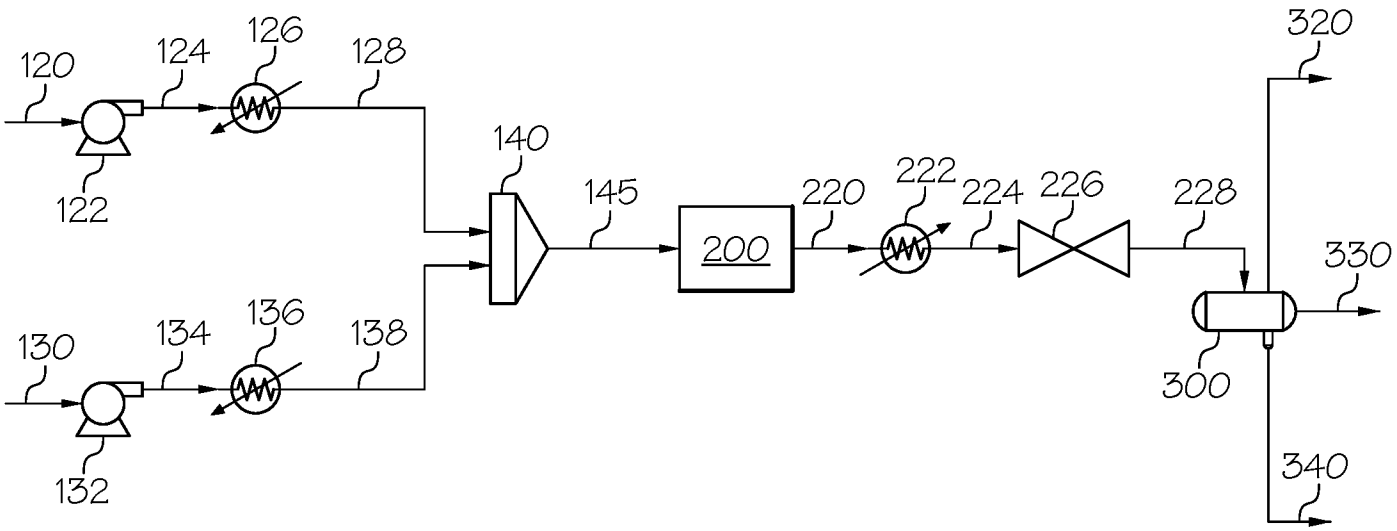
FIG. 4 illustrates a schematic view of an example setup of the SCW unit and first gas-water-oil separator.

A SCW unit and first gas-water-oil separator were set up as shown in FIG. 4. A vacuum residue from Arabian Light crude oil, having the properties shown in Table 1, was used as a crude oil feed. A demineralized water having ASTM Type I specification, as shown in Table 2, was used as a feed water.

TABLE 1

Properties of the Vacuum Residue from Arabian Light Crude Oil

| | Units | Crude Oil Property |
|---|---|---|
| API* Gravity | API | 5.14 |
| Sulfur | WT % | 4.36 |
| Distillation Property(TBP) | | |
| 5% | deg C. | 571 |
| 10% | deg C. | 587 |
| 30% | deg C. | 610 |
| 50% | deg C. | 678 |
| 70% | deg C. | 739 |
| 90% | deg C. | 905 |
| 95% | deg C. | 951 |
| Viscosity @100° C. | cSt | 2324 |
| Salt content | pkb | 29 |
| Vanadium | wtppm | 97 |

*API refers to the American Petroleum Institute.

TABLE 2

Properties of the ASTM Type I Demineralized Water

| | |
|---|---|
| Electrical conductivity, max, μS/cm at 298K (25° C.) | 0.056 |
| Electrical resistivity, min, Mcm at 298K (25° C.) | 18 |
| Total organic carbon (TOC), max, μg/L | 50 |
| Sodium, max, μg/L | 1 |
| Chlorides, max, μg/L | 1 |
| Total silica, max, μg/L | 3 |

Referring now to FIG. 4, the crude oil 130, having a pressure of 0.1 MPa and a temperature of 150 25° C., was fed, at a mass flow of 882.7 tonnes per day (tonne/d) and a liquid volume flow of 5000 barrel/day (bbl/d), into a first feed chamber. The crude oil 130 was then pressurized to a pressure of 27 MPa by a pressure pump 132, and its temperature rose to 151° C. The pressurized crude oil 134 was then heated to a temperature of 180° C. by a heater 136.

The feed water 120, having a pressure of 0.1 MPa and a temperature of 25° C., was fed, at a mass flow rate of 1190.0 tonne/d and a liquid volume flow of 7500 bbl/d, into a second feed chamber. The feed water 120 then was pressurized to a pressure of 27 MPa by a pressure pump 122, and its temperature rose to 27° C. The pressurized feed water 124 was then heated to 480° C. by a heater 126.

The heated and pressurized crude oil 138 and the heated and pressurized feed water 128 were then mixed in a mixer 140. The mixture comprising heated and pressurized product 145 had a pressure of 27 MPa and a temperature of 398° C. The mixture comprising heated and pressurized water was then fed, at a mass flow rate of 2012.7 tonne/d and a liquid volume flow of 12500 bbl/d, into a supercritical water (SCW) unit 200 to produce a first upgraded product 220. The residence time of the mixture comprising heated and pressurized product 145 in the SCW unit 200 was 1.93 minutes (min). The SCW unit 200 was operated at a temperature of 446° C. and a pressure of 27 MPa.

After passing through the SCW unit 200, the first upgraded product 220 had a pressure of 27 MPa, a temperature of 446° C., a mass flow rate of 2012.7 tonne/d, and a liquid volume flow of 13049 bbl/d. The upgraded product was then cooled by a cooler 222 to 151° C. while maintaining the other parameters. The cooled upgraded product 224 was then depressurized by a depressurizer 226 to 0.2 MPa, and its temperature decreased to 125° C. while the flow parameters were maintained. The cooled and depressurized upgraded product 228 was then passed to a gas-water-oil separator 300.

The gas-water-oil separator 300 produced a first gas effluent 320, a first water effluent 330, and a first oil effluent 340. The first gas effluent had a temperature of 50° C., a pressure of 0.2 MPa, a mass flow rate of 37.2 tonne/d, and a liquid volume flow of 488 bbl/d. The composition of the first gas effluent is shown in Table 3. The first water effluent had a temperature of 53° C., a pressure of 0.2 MPa, a mass flow rate of 1167.5 tonne/d, and a liquid volume flow rate of 7360 bbl/d. The properties of the first water effluent are shown in Table 4. The first oil effluent had a temperature of 53° C., a pressure of 0.2 MPa, a mass flow rate of 808.0, and liquid volume flow of 5201 bbl/d. The properties of the first oil effluent are shown in Table 5.

TABLE 3

First Gas Effluent Composition

| Compounds | Mass Fractions |
|---|---|
| $H_2O$ | 5.0% |
| $H_2S$ | 14.0% |
| Hydrogen | 0.9% |
| CO | 1.0% |
| $CO_2$ | 1.1% |
| Methane | 10.2% |
| $C_2$ | 17.2% |
| $C_3$ | 17.7% |
| $C_4$ | 20.7% |
| $C_5$ | 11.0% |
| $C_6$ | 1.0% |

TABLE 4

First Water Effluent Properties

| Properties | |
|---|---|
| Conductivity | 176 uS/cm |
| Salinity | 83 mg/L |
| Total Organic Carbon(TOC) | 1,210 ppm |
| Total Dissolved Solid(TDS) | 113 ppm |

TABLE 5

First Oil Effluent Properties

| | Units | Property |
|---|---|---|
| API Gravity | API | 13.1 |
| Sulfur | WT % | 3.27 |
| Distillation Property(TBP) | | |
| 5% | deg C. | 405 |
| 10% | deg C. | 447 |
| 30% | deg C. | 521 |
| 50% | deg C. | 578 |
| 70% | deg C. | 634 |
| 90% | deg C. | 724 |
| 95% | deg C. | 768 |
| Viscosity @50° C. | cSt | 685 |
| Salt content | pkb | 3 |
| Vanadium | wtppm | 25 |

The first water effluent was then mixed with raw water having the properties shown in Table 6. The mixing ratio was 75% volume first water effluent to 25% volume raw water.

TABLE 6

| Raw Water Properties | |
|---|---|
| Properties | |
| Conductivity | 2,485 μS/cm |
| Salinity | 1,251 mg/L |
| Total Organic Carbon(TOC) | 61 ppm |
| Total Dissolved Solid(TDS) | 1,590 ppm |

The first water effluent and raw water mixture was then separated in a first water treatment unit. Specifically, the mixture was first pre-filtered by passing the mixture through a depth filter to remove any solid particles or residual oil. Then, the mixture was passed through a series of reverse osmosis (RO) membranes to produce a recycled water stream and a rejected water stream. The recycled water stream from the RO membranes was then subjected to an ion exchange resin bed. Recovery of the recycle water stream from the first water treatment unit was 85% by volume. The recycle water stream was then subjected to an ion-exchanger bed that acted as a polisher to reduce the conductivity of the recycle water stream below 1 μS/cm. After this polishing step, the recycle water stream was recycled to the SCW unit. The properties of the recycle water stream and the rejected water stream after separation in the first water treatment unit are shown in Table 7.

TABLE 7

| Recycle Water Stream and Rejected Water Stream Properties | | |
|---|---|---|
| Properties | Recycle Water Stream | Rejected Water Stream |
| Conductivity | 1.5 μS/cm | 4,981 μS/cm |
| Salinity | <1 mg/L | 2,108 m/L |
| Total Organic Carbon(TOC) | <1 ppm | <1 ppm |
| Total Dissolved Solid(TDS) | 0.96 ppm | 3,195 ppm |

Inventive Example

Figure 5:
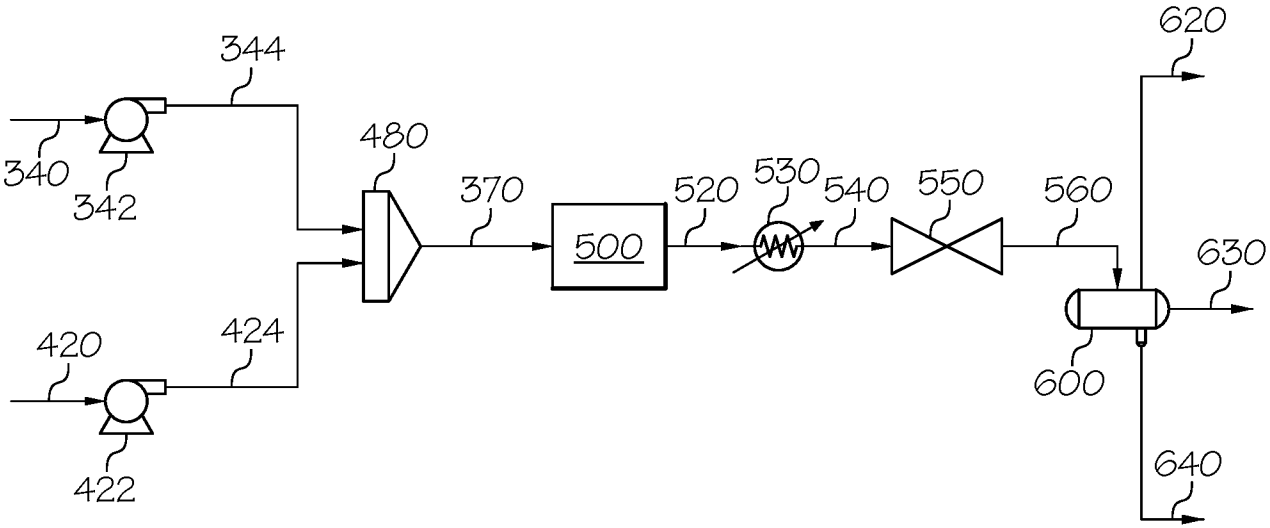
FIG. 5 illustrates a schematic view of an example setup of the NCW unit and second gas-water-oil separator.

Referring now to FIG. 5, a first oil effluent 340 and a rejected water stream 420 were prepared using the same conditions as those of the comparative example. The first oil effluent 340 had a pressure of 0.2 MPa, a temperature of 55° C., a mass flow ratio of 808.0 tonne/d, and a liquid volume flow of 5191 bbl/d. The first oil effluent 340 was then pressurized by a pressure pump 342 to 23 MPa, and its temperature rose slightly to 57° C.

The rejected water stream 420, with a temperature of 35° C., a pressure of 0.1 MPa, a mass flow rate of 219.0 tonne/d, and a liquid volume flow of 1380 bbl/d, was then pressurized by a pressure pump 422 to 23 MPa, and its temperature rose slightly to 37° C.

The pressurized first oil effluent 344 and the pressurized rejected water stream 424 were then mixed in a mixer 480. The mixture comprising the pressurized first oil effluent and the pressurized rejected water stream 370 had a temperature of 50° C., a pressure of 23 MPa, a mass flow rate of 1027.0 tonne/d, and a liquid volume flow of 6571 bbl/d. The mixture comprising the pressurized first oil effluent and the pressurized rejected water stream 370 was then fed into a nearcritical water (NCW) unit 500. The residence time in the NCW unit 500 was 45 minutes, and the NCW unit 500 was a continuously stirred tank reactor. The NCW unit 500 was operated at a temperature of 320° C. and a pressure of 23 MPa.

After processing through the NCW unit 500, the upgraded product 520 had a temperature of 320° C., a pressure of 23 MPa, a mass flow ratio of 1027.0 tonne/d, and a liquid volume flow of 6697 bbl/d. The upgraded product was then cooled by a cooler 530 to 45° C., while maintaining the other parameters. The pressure of the cooled upgraded product 540 was then reduced by a depressurizer 550 to 0.17 MPa, and the temperature rose slightly to 52° C. The cooled and depressurized upgraded product 560 was then fed into a second gas-water-oil separator 600.

The second gas-water-oil separator 600 produced a second gas effluent 620, a second water effluent 630, and a second oil effluent 640. The second gas effluent had a temperature of 35° C., a pressure of 0.17 MPa, a mass flow rate of 21.3 tonne/d, and a gas volume flow of 225 bbl/d. The second water effluent had a temperature of 35° C., a pressure of 0.17 MPa, a mass flow rate of 222.1 tonne/d, and a liquid volume flow of 1401 bbl/d. The second oil effluent had a temperature of 35° C., a pressure of 0.17 MPa, a mass flow rate of 783.6 tonne/d, and a liquid volume flow of 5071 bbl/d. The properties of the second oil effluent are shown in Table 8.

TABLE 8

| Second Oil Effluent Properties | | |
|---|---|---|
| | Units | Property |
| API Gravity | API | 14.2 |
| Sulfur | WT % | 1.93 |
| Distillation Property(TBP) | | |
| 5% | deg C. | 390 |
| 10% | deg C. | 429 |
| 30% | deg C. | 506 |
| 50% | deg C. | 563 |
| 70% | deg C. | 619 |
| 90% | deg C. | 689 |
| 95% | deg C. | 713 |
| Viscosity @50° C. | cSt | 185 |
| Salt content | pkb | <1 |
| Vanadium | wtppm | 9 |

Comparing properties of the first oil effluent, which only underwent treatment in the SCW unit, with the second oil effluent, which underwent treatment in both a SCW unit and a NCW unit, it is clear that the sulfur content in the second oil effluent is lower. Specifically, the data shows that passing a crude oil though both a SCW unit and a NCW unit lowers the sulfur content by 1.93 weight percent (wt %) compared to only passing a crude oil though a SCW unit. This significant decrease in sulfur content occurs because the nearcritial water conditions allow for the salt in the rejected water stream to have a catalytic effect, including catalyzing hydrodesulfurization reactions. Furthermore, these results suggest that more stable carbon-sulfur bonds, such as the carbon-sulfur bonds present in aromatic sulfur compounds with benzothiophenic structures, are being broken using both SCW and NCW processes when compared to only SCW processes. The breaking of stable carbon-hydrogen bonds may result in products with lower boiling points.

A first aspect of the present disclosure is directed to a process for upgrading a crude oil. The process may comprise combining crude oil and feed water in a supercritical water (SCW) unit to produce a first upgraded output, wherein the feed water has a salinity defined by a conductivity of less than 1 microsiemens (μS)/centimeters (cm) and the SCW unit operates at a pressure greater than a critical pressure of water and a temperature greater than a critical temperature of water. The process may also comprise separating the first upgraded output in a first gas-water-oil separator to produce a first gas effluent, a first water effluent, and a first oil effluent. The process may also comprise separating the first water effluent in a first water treatment unit to produce a rejected water stream having a salinity defined by a conductivity from 10 to 1500 μS/cm, and a recycle water stream having a salinity defined by a conductivity less than 2 μS/cm. The process may also comprise combining the first oil effluent and the rejected water stream in a nearcritical water (NCW) unit to produce a second upgraded output, where the NCW unit operates at a pressure below 22 MPa and a temperature of 200 to 374° C. The process may also comprise recycling at least a portion of the recycle water stream for introduction into the SCW unit.

A second aspect of the present disclosure may include the first aspect where the process further comprises separating the second upgraded output in a second gas-water-oil separator to produce a second gas effluent, a second water effluent, and a second oil effluent. The process may also comprise separating the second water effluent in a second water treatment unit to produce a treated water stream, and a discharged water stream. The process may also comprise passing at least a portion of the treated water stream back to the first water treatment unit.

A third aspect of the present disclosure may include any of the previous aspects where the process further comprises combining raw water having a salinity defined by a conductivity from 10 to 1500 μS/cm with the first water effluent before the first water effluent is separated in the first water treatment unit.

A fourth aspect of the present disclosure may include any of the previous aspects where separating the first water effluent in a first water treatment unit comprises passing the first water effluent through at least one pre-filter.

A fifth aspect of the present disclosure may include the fourth aspect where separating the first water effluent in a first water treatment unit further comprises passing the first water effluent through at least one impurity partitioning membrane.

A sixth aspect of the present disclosure may include the fourth or fifth aspects where the process further comprises passing the first water effluent through a polisher.

A seventh aspect of the present disclosure may include any of the previous aspects where the at least a portion of the recycle water stream is introduced to the SCW unit as at least a portion of the feed water.

An eighth aspect of the present disclosure may include any of the previous aspects where the NCW unit operates at a pressure of 22 to 35 MPa and a temperature of 250 to 350° C.

A ninth aspect of the present disclosure may include any of the previous aspects where the mixture comprising the crude oil and the feed water are in a turbulent flow regime with a Reynolds number greater than or equal to 3000.

A tenth aspect of the present disclosure may include any of the previous aspects where the crude oil comprises at least 0.2% sulfur by weight.

An eleventh aspect of the present disclosure may include any of the previous aspects where the feed water comprises a sodium content less than or equal to 5 μg/L.

A twelfth aspect of the present disclosure may include any of the previous aspects where the feed water comprises a chloride content of less than or equal to 5 μg/L.

A thirteenth aspect of the present disclosure may include any of the previous aspects where the feed water comprises a silica content of less than or equal to 3 μg/L.

A fourteenth aspect of the present disclosure may include any of the previous aspects where the feed water and crude oil have a flow rate ratio of from 1:10 to 1:0.1 at standard ambient temperature and pressure (SATP).

A fifteenth aspect of the present disclosure may include any of the previous aspects where the crude oil comprises at least 10% heavy fraction by weight.

A sixteenth aspect of the present disclosure may include any of the previous aspects where the mixture comprising the crude oil and the feed water have a residence time in the SCW unit of greater than or equal to 10 seconds and less than or equal to 60 minutes.

A seventeenth aspect of the present disclosure may include any of the previous aspects where the first oil effluent and the rejected water stream have a residence time in the NCW unit of greater than or equal to 1 minute and less than or equal to 300 minutes.

An eighteenth aspect of the present disclosure may include any of the previous aspects where the rejected water stream has a combined alkali metal and alkaline earth metal concentration from 500 to 15,000 ppm.

A nineteenth aspect of the present disclosure may include any of the previous aspects where the second treated water stream comprises a combined alkali metal and alkaline earth metal concentration of from 5 to 1,200 ppm by weight.

A twentieth aspect of the present disclosure may include any of the previous aspects where the second treated water stream comprises a conductivity of from 10 to 1,500 μS/cm.

A twenty-first aspect of the present disclosure may include any of the previous aspects where the second treated water stream comprises from 5 to 300 mg/L total dissolved solid.

A twenty-second aspect of the present disclosure may include a system for upgrading crude oil. The system may comprise a supercritical water (SCW) unit, where SCW unit upgrades a mixture comprising crude oil and feed water having salinity defined by a conductivity of less than 1 microsiemens (μS)/centimeters (cm); and the SCW unit operates at a pressure greater than a critical pressure of water and a temperature greater than a critical temperature of water. The system may also comprise a first gas-water-oil separator disposed downstream of the SCW unit and operable to separate a first upgraded output to produce a first gas effluent, a first water effluent, and a first oil effluent. The system may also comprise a first water treatment unit disposed downstream of the first gas-water-oil separator to separate the first water effluent to produce a rejected water stream having salinity defined by a conductivity from 10 to 1500 μS/cm, and a recycle water stream having salinity defined by a conductivity less than 2 μS/cm. The system may also further comprise a nearcritical water (NCW) unit operable to upgrade a mixture comprising the first oil effluent and the rejected water stream; where the NCW unit operates at a pressure of higher than 22 MPa and a temperature of 200 to 370° C.

A twenty-third aspect of the present disclosure may include the twenty-second aspect where the system further comprises a second gas-water-oil separator, where the second gas-water-oil separator is operable to separate a second upgraded output to produce a second gas effluent, a second water effluent, and a second oil effluent. The system may also comprise a second water treatment unit, where the second water treatment unit is operable to separate the second water effluent to produce a second treated water stream and a discharged water stream.

A twenty-fourth aspect of the present disclosure may include the twenty-second and twenty-third aspects where at least a portion of the treated water stream is passed back to the first water treatment unit.

A twenty-fifth aspect of the present disclosure may include the twenty-second through twenty-fourth aspects where the recycle water stream is at least partially recycled for use as feed water.

What is claimed is:

1. A process for upgrading crude oil, the process comprising:

upgrading crude oil and feed water in a supercritical water (SCW) unit to produce a first upgraded output, wherein the feed water having a salinity defined by a conductivity of less than 1 microsiemens (μS)/centimeters (cm); and the SCW unit operates at a pressure greater than a critical pressure of water and a temperature greater than a critical temperature of water;

separating the first upgraded output in a first gas-water-oil separator to produce a first gas effluent, a first water effluent, and a first oil effluent;

separating the first water effluent in a first water treatment unit to produce a rejected water stream having a salinity defined by a conductivity from 10 to 1500 μS/cm, and a recycle water stream having a salinity defined by a conductivity less than 2 μS/cm;

upgrading the first oil effluent and the rejected water stream in a nearcritical water (NCW) unit to produce a second upgraded output, where the NCW unit operates at a pressure above 22 MPa and a temperature of 200 to 370° C.; and recycling at least a portion of the recycle water stream for introduction into the SCW unit.

2. The process of claim 1, further comprising:

separating the second upgraded output in a second gas-water-oil separator to produce a second gas effluent, a second water effluent, and a second oil effluent;

separating the second water effluent in a second water treatment unit to produce a treated water stream, and a discharged water stream; and passing at least a portion of the treated water stream back to the first water treatment unit.

3. The process of claim 1, further comprising combining raw water having a salinity defined by a conductivity from 10 to 1500 μS/cm with the first water effluent before the first water effluent is separated in the first water treatment unit.

4. The process of claim 1, where separating the first water effluent in a first water treatment unit comprises:

passing the first water effluent through at least one prefilter; and passing the first water effluent through at least one impurity partitioning membrane.

5. The process of claim 4, further comprising passing the first water effluent through a polisher.

6. The process of claim 1, where the at least a portion of the recycle water stream is introduced to the SCW unit as at least a portion of the feed water.

7. The process of claim 1, where the NCW unit operates at a pressure of 22 to 35 MPa and a temperature of 250 to 350° C.

8. The process of claim 1, where a mixture comprising crude oil and feed water are in a turbulent flow regime with a Reynolds number greater than or equal to 3000.

9. The process of claim 1, where the crude oil comprises at least 0.2% sulfur by weight.

10. The process of claim 1, where the crude oil comprises at least 100 ppm nitrogen by weight.

11. The process of claim 1, where the feed water comprises:

a sodium content less than or equal to 5 μg/L;

a chloride content of less than or equal to 5 μg/L; and a silica content of less than or equal to 3 μg/L.

12. The process of claim 1, where the feed water and crude oil have a flow rate ratio of from 1:10 to 1:0.1 at standard ambient temperature and pressure (SATP).

13. The process of claim 1, where the crude oil comprises at least 10% heavy fraction by weight.

14. The process of claim 1, where a mixture comprising crude oil and feed water have a residence time in the SCW unit of greater than or equal to 10 seconds and less than or equal to 60 minutes.

15. The process of claim 1, where the first oil effluent and the rejected water stream have a residence time in the NCW unit of greater than or equal to 1 minute and less than or equal to 300 minutes.

16. The process of claim 1, where the rejected water stream has a combined alkali metal and alkaline earth metal concentration from 500 to 15,000 ppm by weight.

17. The process of claim 1, where the treated water stream comprises:

a combined alkali metal and alkaline earth metal concentration of from 5 to 1,200 ppm by weight;

a conductivity of from 10 to 1,500 μS/cm; and from 5 to 300 mg/L total dissolved solid.

18. A system for upgrading crude oil, the system comprising:

a supercritical water (SCW) unit, where:

the SCW unit is operable to upgrade a mixture comprising crude oil and feed water having salinity defined by a conductivity of less than 1 microsiemens (μS)/centimeters (cm); and the SCW unit operates at a pressure greater than a critical pressure of water and a temperature greater than a critical temperature of water;

a first gas-water-oil separator disposed downstream of the SCW unit and operable to separate a first upgraded output to produce a first gas effluent, a first water effluent, and a first oil effluent;

a first water treatment unit disposed downstream of the first gas-water-oil separator operable to separate the first water effluent to produce a rejected water stream having salinity defined by a conductivity from 10 to 1500 μS/cm, and a recycle water stream having salinity defined by a conductivity less than 2 μS/cm;

a nearcritical water (NCW) unit operable to upgrade a mixture comprising the first oil effluent and the rejected water stream; where the NCW unit operates at a pressure of higher than 22 MPa and a temperature of 200 to 370° C.

19. The system of claim 18, further comprising:

a second gas-water-oil separator, where the second gas-water-oil separator is operable to separate a second upgraded output to produce a second gas effluent, a second water effluent, and a second oil effluent;

a second water treatment unit, where the second water treatment unit is operable to separate the second water effluent to produce a treated water stream and a discharged water stream; and where at least a portion of the treated water stream is passed back to the first water treatment unit.

20. The system of claim 18, where the recycle water stream is at least partially recycled for use as feed water.

* * * * *